US009044984B2

(12) United States Patent
Ueshima

(10) Patent No.: US 9,044,984 B2
(45) Date of Patent: Jun. 2, 2015

(54) INK JET RECORDING APPARATUS AND METHOD

(71) Applicant: FUJIFILM Corporation, Tokyo (JP)

(72) Inventor: Masashi Ueshima, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/467,430

(22) Filed: Aug. 25, 2014

(65) Prior Publication Data

US 2015/0062224 A1 Mar. 5, 2015

(30) Foreign Application Priority Data

Aug. 27, 2013 (JP) ..... 2013-175603

(51) Int. Cl.
*B41J 29/38* (2006.01)

(52) U.S. Cl.
CPC ..... *B41J 29/38* (2013.01)

(58) Field of Classification Search
USPC ..... 347/14, 19, 20, 37, 40, 74, 78, 81, 82
See application file for complete search history.

(56) References Cited

U.S. PATENT DOCUMENTS 8,403,445 B2 * 3/2013 Iwasaki ..... 347/14

FOREIGN PATENT DOCUMENTS

JP 2010-082989 A 4/2010
JP 2011-201051 A 10/2011

OTHER PUBLICATIONS

The extended European search report issued by the European Patent Office on Mar. 19, 2015, which corresponds to European Patent Application No. 14182307.0-1701 and is related to U.S. Appl. No. 14/467,430.

* cited by examiner

*Primary Examiner* — Thinh Nguyen
(74) *Attorney, Agent, or Firm* — Studebaker & Brackett PC

(57) ABSTRACT

The present invention relates to an ink jet recording apparatus and method. In an aspect of the present invention, uneven concentration correction and non-ejection correction are performed at the time of drawing an image. In the non-ejection correction, a non-ejecting nozzle and a deflected ejection nozzle are detected as a defective nozzle, the detected defective nozzle is not allowed to eject ink to perform the non-ejection correction. When a deflected ejection nozzle is detected, an allowable value range of a deflected ejection amount of each of nozzles with respect to a deflected ejection amount of each of nozzles at the time of creating an uneven concentration correction parameter is determined. A nozzle in which a deflected ejection amount exceeds the allowable value range so that the deflected ejection occurs is detected as a deflected ejection nozzle.

16 Claims, 15 Drawing Sheets

INK JET RECORDING APPARATUS AND METHOD

CROSS-REFERENCE TO RELATED APPLICATIONS

The patent application claims priority under 35 U.S.C. §119 to Japanese Patent Application No. 2013-175603, filed on Aug. 27, 2013. Each of the above application(s) is hereby expressly incorporated by reference, in its entirety, into the present application.

BACKGROUND OF THE INVENTION

1. Field of the Invention

The present invention relates to an ink jet recording apparatus and a method, and more particularly to a correction technique when a nozzle causes deflected ejection.

2. Description of the Related Art

After an ink jet head mounted on an ink jet recording apparatus is started to be used, a nozzle which has fallen into a non-ejecting state (non-ejecting nozzle) due to clogging or failure may occur. If a non-ejecting nozzle occurs in an ink jet recording apparatus of a single path method, a "streak" appears in a drawn image to remarkably lower quality of the image. Thus, in an ink jet recording apparatus of the single path method, if a non-ejecting nozzle occurs, processing of reducing visibility of a streak (non-ejection correction) is performed.

FIGS. 14A to 14F are conceptual diagrams showing a basic idea of non-ejection correction.

FIGS. 14A to 14F are as follows: FIG. 14A shows schematic dot arrangement when there is no non-ejecting nozzle; FIG. 14B shows schematic visual appearance of an output image (image drawn on a medium) when there is no non-ejecting nozzle; FIG. 14C shows schematic dot arrangement when a non-ejecting nozzle occurs; FIG. 14D shows schematic visual appearance of an output image when a non-ejecting nozzle occurs; FIG. 14E shows schematic dot arrangement when non-ejection correction is performed; and FIG. 14F shows schematic visual appearance of an output image when non-ejection correction is performed.

As shown in FIG. 14D, if a non-ejecting nozzle occurs, a streak (streak of a ground color of a medium) occurs in a drawing region corresponding to the non-ejecting nozzle.

As described above, the non-ejection correction serves as processing of reducing visibility of the streak. The processing is achieved by thickening drawing with a nozzle (non-ejection correction nozzle) close to the non-ejecting nozzle as shown in FIG. 14E.

A method of thickening drawing with a non-ejection correction nozzle is known as a method of scanning an output image, a method of increasing an ejection dot diameter by enhancing an ejection signal, and the like.

As shown in FIG. 14F, performing the non-ejection correction reduces visibility of the streak to improve image quality, however, the image quality is lowered as compared with image quality when there is no non-ejecting nozzle.

A streak appearing on an image occurs due to not only non-ejection but also deflected ejection (indicating directional ejection failure of an ink droplet ejected from a nozzle).

FIGS. 15A to 15D are conceptual diagrams showing an occurrence mechanism of a streak caused by deflected ejection.

FIGS. 15A to 15D are as follows: FIG. 15A shows schematic dot arrangement when there is no deflected ejection; FIG. 15B shows schematic visual appearance of an output image when there is no deflected ejection; FIG. 15C shows schematic dot arrangement when the deflected ejection occurs; and FIG. 15D shows schematic visual appearance of an output image when deflected ejection occurs.

If deflected ejection occurs, ink is not ejected to a position where the ink should be originally ejected to cause a streak to appear in a drawn image. In addition, if deflected ejection occurs, adjacent dots overlapping too much may be visually identified as a streak (concentration of the dots becoming too high results in allowing the dots to be visually identified as a streak).

In a case where a streak occurs in an image due to deflected ejection, a nozzle in which the deflected ejection occurs (deflected ejection nozzle) is not allowed to eject ink to perform non-ejection correction (refer to FIGS. 14E and 14F). Accordingly, occurrence of the streak caused by the deflected ejection is canceled to improve image quality, however, the image quality is lowered as compared with image quality when deflected ejection does not occur (refer to FIGS. 14B and 14F).

Deflected ejection does not always constantly occur, but changes as time elapses depending on a usage manner of an ink jet head. Thus, in order to maintain always stable image quality, it is necessary to regularly detect a nozzle in which deflected ejection occurs (deflected ejection nozzle).

A method of detecting a deflected ejection nozzle is known as a method in which a test chart is drawn to analyze an image of the drawn test chart so that a deposited position of ink is measured to identify a deflected ejection nozzle by comparing with a reference position, and the like (refer to Japanese Patent Application Laid-Open No. 2011-201051, for example).

In the method above, a nozzle position is applied to the reference position set as a comparison object, that is, a deposited position of the ink with the assumption that deflected ejection does not occur is set as the reference position.

SUMMARY OF THE INVENTION

However, detection based on a nozzle position does not always provide the best result. One example thereof is a case where uneven concentration correction is performed (refer to Japanese Patent Application Laid-Open No. 2010-082989 with regard to uneven concentration correction, for example).

Performing uneven concentration correction can provide favorable image quality by an effect of uneven concentration correction even if deflected ejection occurs to some extent. Thus, when uneven concentration correction is performed, if a deflected ejection nozzle is uniformly detected for every nozzle on the basis of a nozzle position, image quality may be conversely lowered, that is, a state where non-ejection correction is applied to a nozzle that is not reasonably required to be corrected, or non-ejection correction is not applied to a nozzle that is reasonably required to be corrected, may occur to lower image quality.

The present invention is made in light of the above-mentioned circumstances, and an object of the present invention is to provide an ink jet recording apparatus and method, capable of maintaining favorable image quality by properly detecting a deflected ejection nozzle to perform non-ejection correction.

Solutions for solving the problem above are as follows.

According to a first aspect of the present invention, an ink jet recording apparatus includes: an ink jet head for ejecting ink droplets from a plurality of nozzles to draw an image on a medium; a deflected ejection amount detector for detecting a deflected ejection amount of each of the nozzles; an uneven concentration correction parameter creation part for creating an uneven concentration correction parameter required for uneven concentration correction by analyzing an image of a test chart drawn on the medium by the ink jet head; an uneven concentration correction part for performing uneven concentration correction on the basis of the uneven concentration correction parameter created by the uneven concentration correction parameter creation part; an allowable value range determination part for determining an allowable value range of a deflected ejection amount for each of the nozzles with respect to a deflected ejection amount of each of the nozzles when the test chart is drawn; a deflected ejection nozzle detector for detecting a nozzle in which a deflected ejection amount exceeds the allowable value range so that a deflected ejection occurs as a deflected ejection nozzle; and a non-ejection correction part for performing non-ejection correction by not allowing deflected ejection nozzle to eject ink.

According to the first aspect, an allowable value range of a deflected ejection amount available to a normal nozzle is determined for each of the nozzles. In addition, in the first aspect, the allowable value range is determined with respect to a deflected ejection amount of each of the nozzles at the time of creating an uneven concentration correction parameter.

Performing uneven concentration correction can maintain favorable image quality by an effect of uneven concentration correction even if deflected ejection occurs to some extent. Thus, when the uneven concentration correction is performed in a state where deflected ejection occurs, an allowable value range of a deflected ejection amount in order to maintain favorable image quality determined on the basis of the deflected ejection amount of each of the nozzles when the uneven concentration correction parameter is created can provide a more favorable result than that determined on the basis of a nozzle position.

The uneven concentration correction parameter is created by drawing a predetermined test chart and analyzing an image of the test chart. Thus, it is possible to obtain a deflected ejection amount of each of the nozzles when the uneven concentration correction parameter is created by detecting a deflected ejection amount of each of the nozzles when the test chart is drawn.

According to the first aspect, since an allowable value range of a deflected ejection amount is determined with respect to a deflected ejection amount of each of nozzles when an image of a test chart for creating an uneven concentration correction parameter is drawn, it is possible to more properly detect a deflected ejection nozzle to properly perform non-ejection correction.

In a second aspect according to the ink jet recording apparatus of the first aspect, the allowable value range determination part determines a range of values higher and lower by a predetermined value than a deflected ejection amount of each of nozzles when the test chart is drawn as an allowable value range.

According to the second aspect, a range of values higher and lower by a predetermined value than a deflected ejection amount at the time of creating an uneven concentration correction parameter is determined as an allowable value range. Accordingly, it is possible to simply determine an allowable value range of a deflected ejection amount of each of nozzles.

A third aspect according to the ink jet recording apparatus of the first aspect further includes a storage part for storing information on the allowable value range to be determined corresponding to a deflected ejection amount when the test chart is drawn, and in the allowable value range determination part, the allowable value range is determined by referring to the information stored in the storage part.

According to the third aspect, the allowable value range to be determined corresponding to a deflected ejection amount at the time of creating an uneven concentration correction parameter is predetermined. The allowable value range of a deflected ejection amount of each of nozzles is determined by referring to information on the allowable value range. An allowable value range settable to each of nozzles differs depending on a deflected ejection amount at the time of creating an uneven concentration correction parameter. Thus, it is possible to more properly determine an allowable value range by determining the allowable value range corresponding to a deflected ejection amount at the time of creating an uneven concentration correction parameter to properly detect a deflected ejection nozzle.

Information showing a relationship between a deflected ejection amount at the time of creating an uneven concentration correction parameter and an allowable value range to be determined is prepared, for example, as a table so as to be stored in the storage part. It is possible to determine the relationship between a deflected ejection amount at the time of creating an uneven concentration correction parameter and an allowable value range to be determined, for example, by desk study such as theory and simulation, study by experiment, and the like.

In a fourth aspect according to the ink jet recording apparatus of the third aspect, information on the allowable value range to be determined corresponding to a deflected ejection amount when the test chart is drawn is determined for each of the nozzles, and stored in the storage part.

According to the fourth aspect, the allowable value range to be determined corresponding to a deflected ejection amount at the time of creating an uneven concentration correction parameter is determined for each of the nozzles. Since an allowable value range settable to each of the nozzles differs for each of the nozzles, it is possible to more properly determine the allowable value range by predetermining a relationship between a deflected ejection amount at the time of creating an uneven concentration correction parameter and an allowable value range to be determined, for each of the nozzles. Accordingly, it is possible to more properly detect a deflected ejection nozzle.

In a fifth aspect according to the ink jet recording apparatus of the third aspect, the nozzles are divided into a plurality of groups, and information on the allowable value range to be determined is determined corresponding to a deflected ejection amount when the test chart is drawn for each of the groups, and stored in the storage part.

According to the fifth aspect, the nozzles are divided into groups, and an allowable value range to be determined is determined corresponding to a deflected ejection amount at the time of creating an uneven concentration correction parameter, in units of the group. The allowable value range of a deflected ejection amount of each of nozzles is determined by referring to information determined in units of the group. It is possible to properly determine the allowable value range by dividing the nozzles into groups to reduce the number of pieces of information to be managed.

For the grouping, it is possible to adopt a method of dividing nozzle surfaces along array directions of nozzles into a plurality of blocks so that the nozzles are grouped in units of the block, a method in which if an ink jet head is formed by joining a plurality of modules, nozzles are grouped in units of the module, and the like.

In a sixth aspect according to the ink jet recording apparatus of any one of third to fifth aspects, as a deflected ejection amount when the test chart is drawn increases, the allowable value range to be determined is determined so as to be narrower.

According to the sixth aspect, as the deflected ejection amount at the time of creating an uneven concentration correction parameter increases, the allowable value range to be determined is narrowly determined. As the deflected ejection amount increases, an effect of uneven concentration correction decreases. Thus, it is possible to properly detect a deflected ejection nozzle to preform non-ejection correction by narrowly determining the allowable value range as the deflected ejection amount at the time of creating an uneven concentration correction parameter increases.

In a seventh aspect of an ink jet recording method of ejecting ink droplets from a plurality of nozzles provided in an ink jet head to draw an image on a medium, the ink jet recording method including performing uneven concentration correction and non-ejection correction at the time of drawing an image, the uneven concentration correction includes the steps of: drawing a test chart on the medium with the ink jet head; analyzing an image of the drawn test chart; creating an uneven concentration correction parameter required for the uneven concentration correction; and performing the uneven concentration correction on the basis of the created uneven concentration correction parameter, and the non-ejection correction includes the steps of: determining an allowable value range of a deflected ejection amount for each of the nozzles with respect to a deflected ejection amount of each of nozzles when the test chart is drawn; detecting a nozzle in which a deflected ejection amount exceeds the allowable value range so that the deflected ejection occurs as a deflected ejection nozzle; and not allowing the detected deflected ejection nozzle to eject ink to perform the non-ejection correction.

According to the seventh aspect, an allowable value range of a deflected ejection amount available to a normal nozzle is determined for each of the nozzles. In addition, in the seventh aspect, the allowable value range is determined with respect to a deflected ejection amount of each of the nozzles at the time of creating an uneven concentration correction parameter. Accordingly, it is possible to properly detect a deflected ejection nozzle to properly perform the non-ejection correction.

In an eighth aspect according to the ink jet recording method of the seventh aspect, a range of values higher and lower by a predetermined value than a deflected ejection amount of each of the nozzles when the test chart is drawn is determined as the allowable value range.

According to the eighth aspect, a range of values higher and lower by a predetermined value than a deflected ejection amount at the time of creating an uneven concentration correction parameter is determined as the allowable value range. Accordingly, it is possible to simply determine the allowable value range of a deflected ejection amount of each of the nozzles.

In a ninth aspect according to the ink jet recording method of the seventh aspect, the allowable value range to be determined is predetermined corresponding to a deflected ejection amount when the test chart is drawn.

According to the ninth aspect, an allowable value range to be determined corresponding to a deflected ejection amount at the time of creating an uneven concentration correction parameter is predetermined. Accordingly, it is possible to more properly determine the allowable value range to more properly detect a deflected ejection nozzle.

In a tenth aspect according to the ink jet recording method of the ninth aspect, the allowable value range to be determined corresponding to a deflected ejection amount when the test chart is drawn is predetermined for each of the nozzles.

According to the tenth aspect, an allowable value range to be determined corresponding to a deflected ejection amount at the time of creating an uneven concentration correction parameter is determined for each of the nozzles. Accordingly, it is possible to more properly determine the allowable value range to more properly detect a deflected ejection nozzle.

In an eleventh aspect according to the ink jet recording method of the ninth aspect, the nozzles are divided into a plurality of groups, and the allowable value range to be determined is predetermined corresponding to a deflected ejection amount when the test chart is drawn for each of the groups.

According to the eleventh aspect, the nozzles are divided into groups, and an allowable value range to be determined is determined corresponding to a deflected ejection amount at the time of creating an uneven concentration correction parameter, in units of the group. Accordingly, it is possible to properly determine the allowable value range while reducing the number of pieces of information to be managed.

In a twelfth aspect according to the ink jet recording method of any one of ninth to eleventh aspects, as a deflected ejection amount when the test chart is drawn increases, the allowable value range to be determined is determined so as to be narrower.

According to the twelfth aspect, as a deflected ejection amount at the time of creating an uneven concentration correction parameter increases, an allowable value range to be determined is determined so as to be narrower. Accordingly, it is possible to properly detect a deflected ejection nozzle to perform non-ejection correction.

According to the present invention, it is possible to maintain favorable image quality by properly detecting a deflected ejection nozzle to perform non-ejection correction.

DETAILED DESCRIPTION OF THE PREFERRED EMBODIMENTS

Referring to accompanying drawings, preferable embodiments of the present invention will be described in detail below.

Description of Ink Jet Recording Apparatus

Overall Configuration

Figure 1:
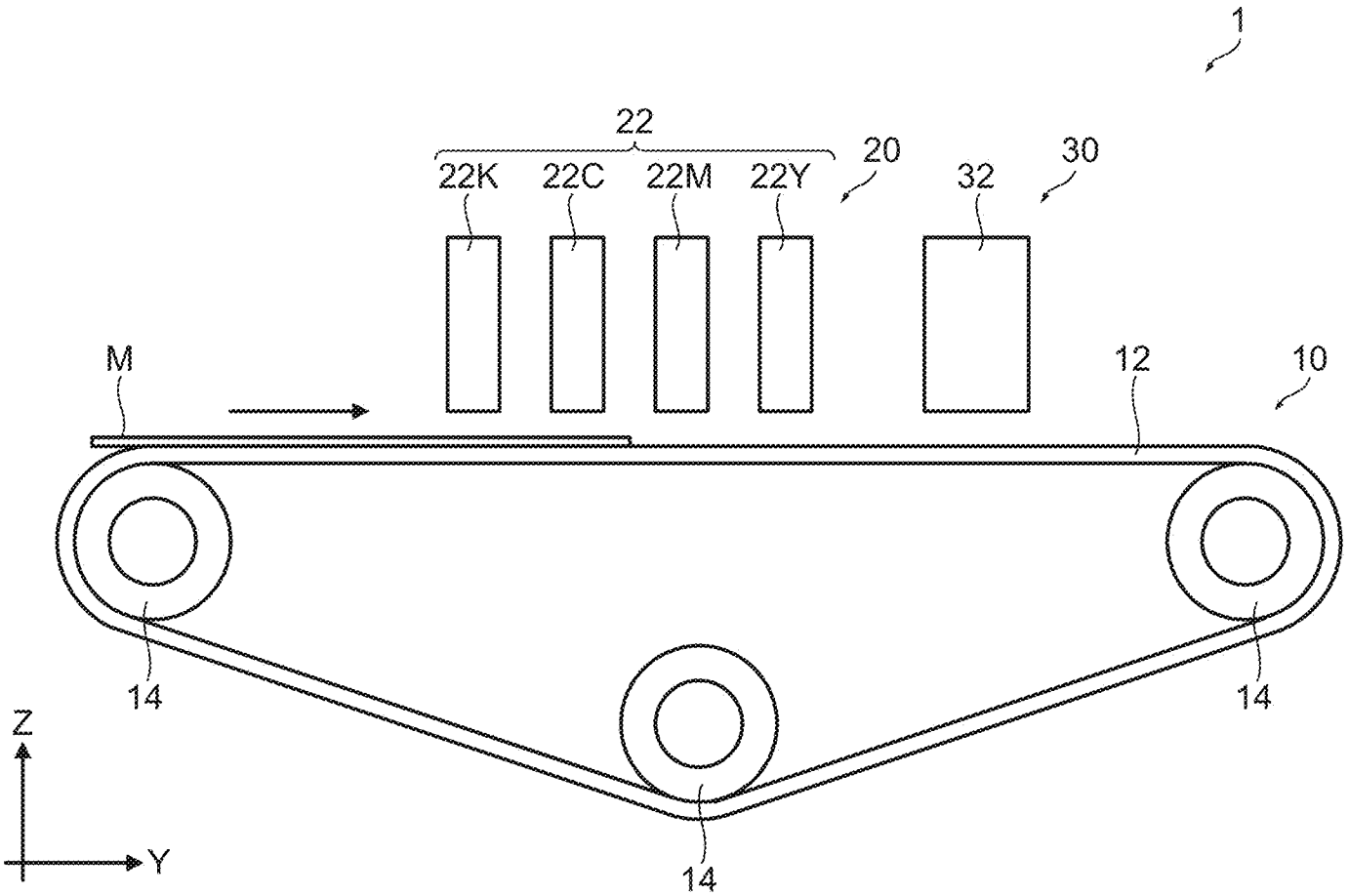
FIG. 1 is a side view showing one embodiment of an ink jet recording apparatus in accordance with the present invention.
Figure 2:
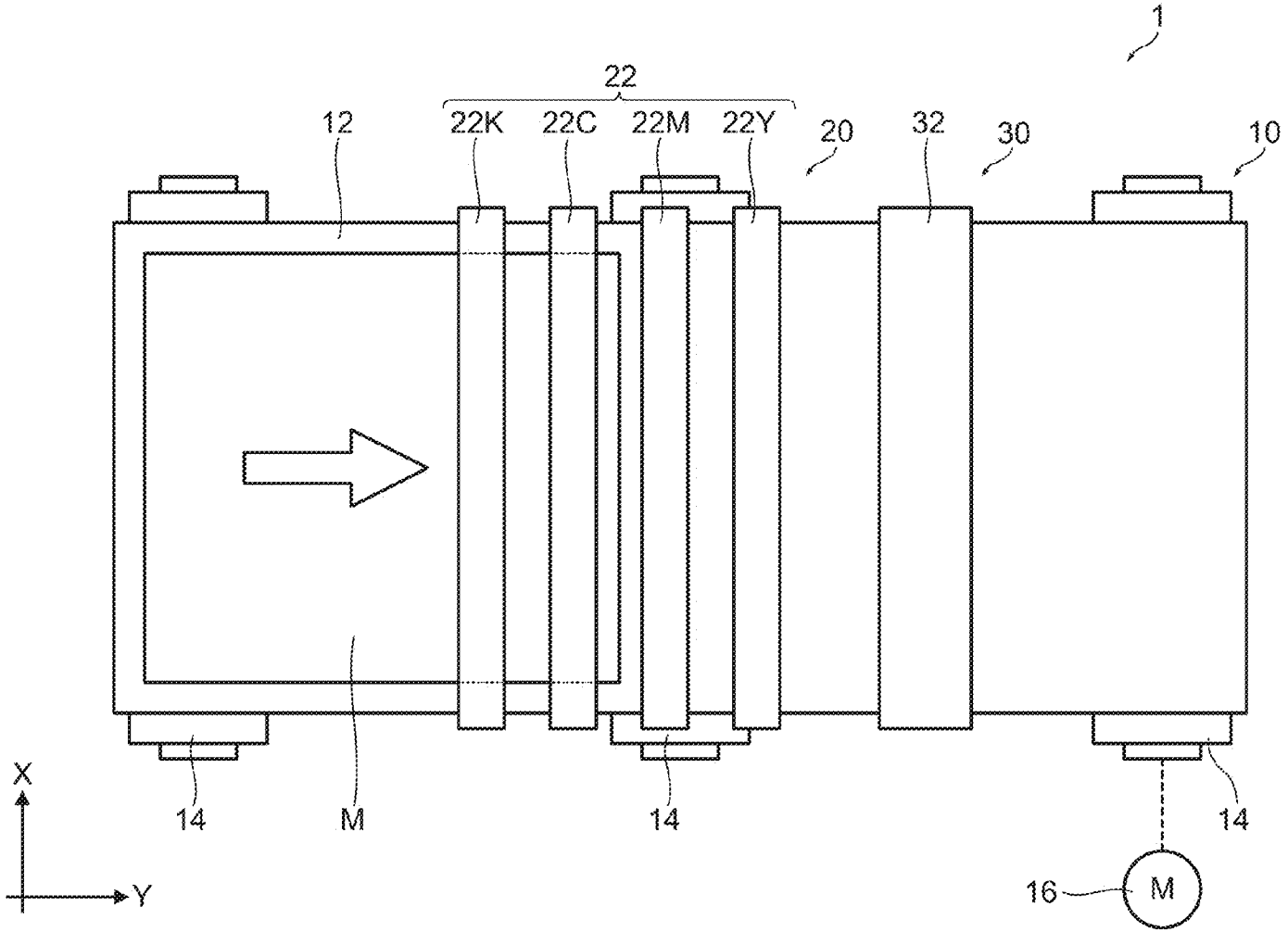
FIG. 2 is a plan view of the ink jet recording apparatus shown in FIG. 1.

FIG. 1 is a side view showing one embodiment of an ink jet recording apparatus 1 in accordance with the present invention. In addition, FIG. 2 is a plan view of the ink jet recording apparatus 1 shown in FIG. 1.

The ink jet recording apparatus 1 serves as a color ink jet recording apparatus using a single path method for drawing a color image on a medium M such as a sheet, and includes: a medium feeding part 10 for feeding the medium M; a drawing part 20 for drawing a color image on the medium M fed by the medium feeding part 10 by ejecting ink droplets of respective colors of black (K), cyan (C), magenta (M), and yellow (Y); and an image reading part 30 for reading an image drawn on the medium M.

The medium feeding part 10 feeds the medium M by allowing it to adhere to a belt 12. The medium feeding part 10 includes: the endless belt 12; a belt drive mechanism for running the belt 12; and an adhesion mechanism (not shown) for allowing the medium M to adhere to the belt 12.

The belt drive mechanism includes a plurality of pulleys 14, and a motor 16 for rotationally driving one of the pulleys 14. The belt 12 is stretched round the pulley 14 to run along a predetermined running path. The running path is determined so that the belt 12 runs horizontally in some sections. The medium M is fed by using the sections where the belt 12 runs horizontally.

The adhesion mechanism allows the medium M to adhere to the belt 12 by using air pressure (negative pressure) or static electricity, for example. In a case where air pressure is used, a large number of small diameter holes are formed in a surface of the belt 12 to generate negative pressure inside the belt 12. Accordingly, the medium M is sucked by holes to allow the medium M to adhere to the belt 12. In a case where static electricity is used, the belt 12 is electrically charged, thereby allowing the medium M to adhere to the belt 12 by electrostatic action.

Feeding the medium M with adhering to the belt 12 allows the medium M to be horizontally fed in the same straight line (in FIG. 2, the medium M is fed in a Y-direction in an XY-plane).

The drawing part 20 includes ink jet heads 22K, 22C, 22M, and 22Y, for ejecting droplets of black (K) ink, cyan (C) ink, magenta (M) ink, and yellow (Y) ink, respectively.

Respective ink jet heads 22K, 22C, 22M, and 22Y constitute a line head capable of drawing an image with a width corresponding to a width of a medium by one path (single path).

The ink jet heads 22K, 22C, 22M, and 22Y are arranged over a feeding path of the medium M defined by the medium feeding part 10 at predetermined intervals. In addition, each of the ink jet heads 22K, 22C, 22M, and 22Y is arranged in a direction orthogonal to a feeding direction (Y-direction) of the medium M, and a nozzle surface (a surface provided with a nozzle) of each of the ink jet heads is arranged so as to face the medium M fed by the medium feeding part 10.

When the medium M fed by the medium feeding part 10 passes under each of the ink jet heads 22K, 22C, 22M, and 22Y, ink droplets are ejected from each of the ink jet heads 22K, 22C, 22M, and 22Y to draw an image on a surface of the medium M.

The image reading part 30 is arranged on a downstream side of the drawing part 20 with respect to the feeding direction (Y-direction) of the medium M defined by the medium feeding part 10. The image reading part 30 includes a scanner 32 that is composed of a line scanner capable of reading an image with a width corresponding to a width of a medium by one path. The scanner 32 is arranged over the feeding path of the medium M defined by the medium feeding part 10, and is arranged in a direction orthogonal to the feeding direction of the medium M.

When the medium M fed by the medium feeding part 10 passes under the scanner 32, an image drawn in a surface of the medium M is read by the scanner 32.

(Structures of Ink Jet Heads)

Structures of the ink jet heads 22K, 22C, 22M, and 22Y will be outlined below.

Since a structure is common to each of the ink jet heads 22K, 22C, 22M, and 22Y corresponding to each color, hereinafter the ink jet heads 22K, 22C, 22M, and 22Y are indicated as an ink jet head 22 to be described except a case where the ink jet heads are particularly distinguished.

Figure 3:
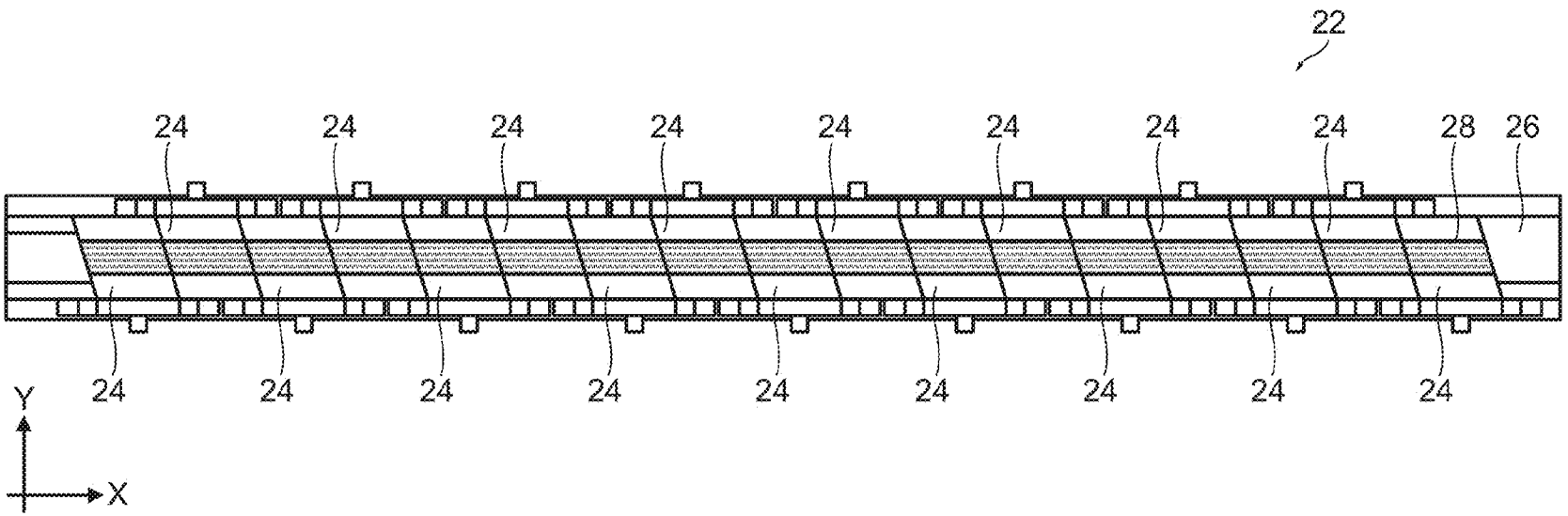
FIG. 3 is a bottom view of an ink jet head.

FIG. 3 is a bottom view of the ink jet head 22.

As shown in FIG. 3, the ink jet head 22 of the present embodiment is formed by joining a plurality of head modules (short ink jet heads) 24 along the longitudinal direction in a line. Each of the head modules 24 is attached to a bar-shaped support frame 26 to be joined in a line, thereby constituting one long ink jet head 22.

Figure 4:
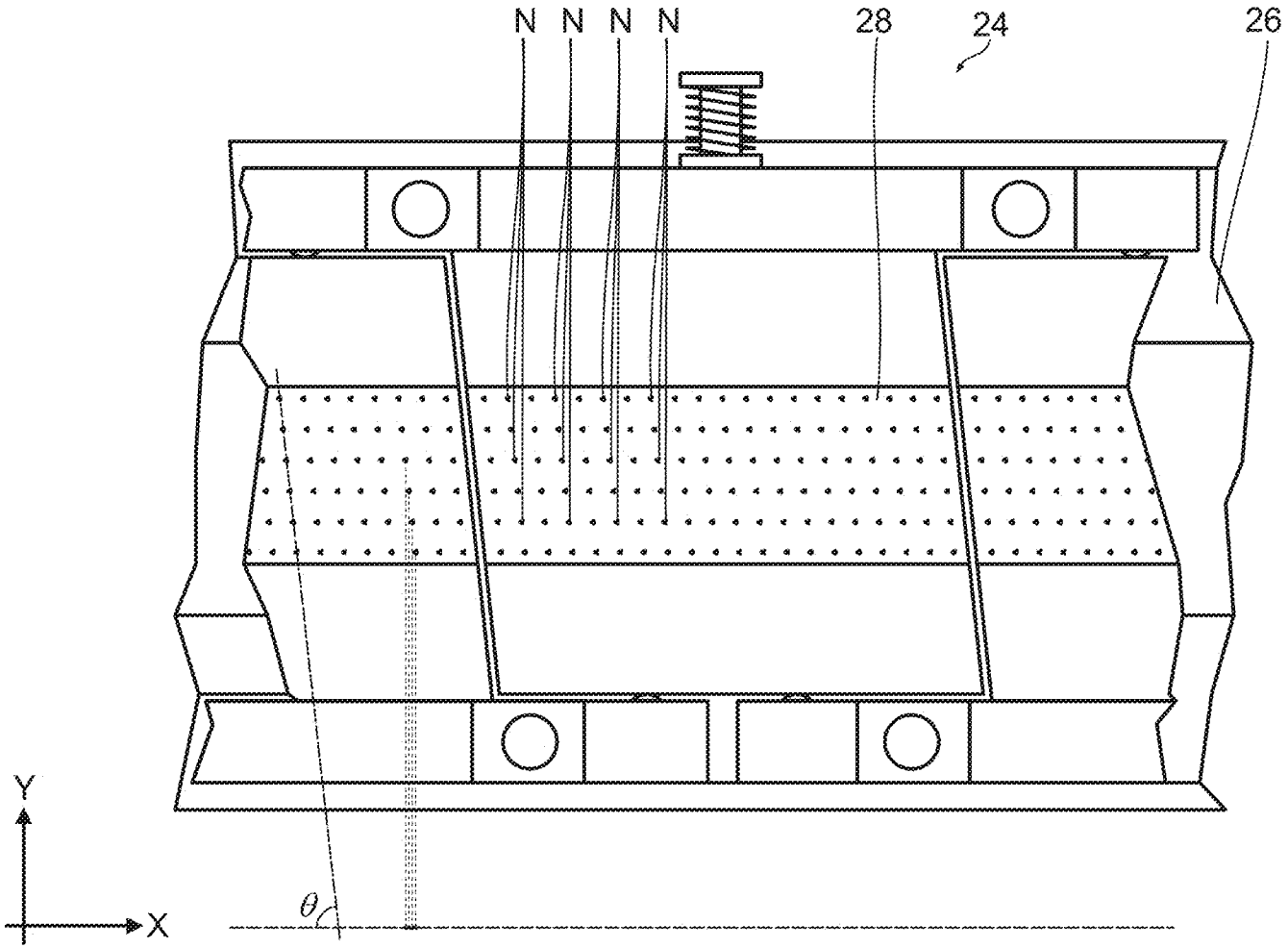
FIG. 4 is a bottom view of a head module.

FIG. 4 is a bottom view of the head module 24. As shown in FIG. 4, the head module 24 is provided in its lower surface with a nozzle surface 28 in which nozzles N are arranged.

In the ink jet head 22 of the present embodiment, the nozzles N are arranged in a matrix in the nozzle surface 28. Specifically, the nozzles N are arranged along a longitudinal direction (X-direction) of the ink jet head 22 at predetermined pitches as well as arranged along a direction inclined at a prescribed angle θ with respect to the longitudinal direction at predetermined pitches. Arranging the nozzles N as above enables substantial arrangement density of the nozzles N arranged along the longitudinal direction (the direction orthogonal to the feeding direction (Y-direction) of the medium M) to become high-density.

Ink droplets are individually ejected from each of the nozzles N. A method of ejecting the ink droplets is not especially limited, and therefore, the ink droplets may be ejected by a piezoelectric method or a thermal method.

Description of Control System

System Configuration

Figure 5:
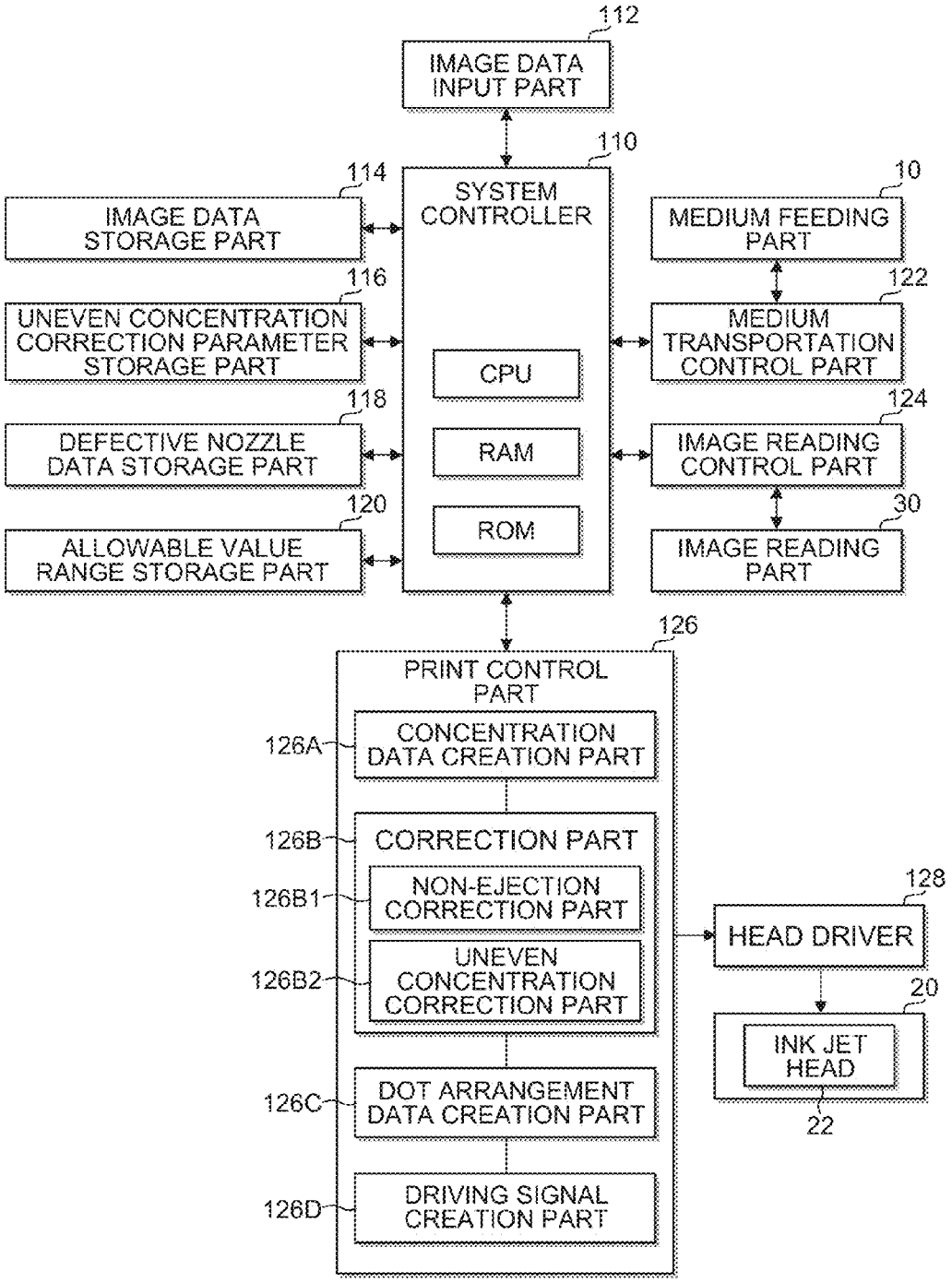
FIG. 5 is a block diagram showing a system configuration of an ink jet recording apparatus.

FIG. 5 is a block diagram showing a system configuration of the ink jet recording apparatus 1.

As shown in FIG. 5, the ink jet recording apparatus 1 of the present embodiment includes: a system controller 110; an image data input part 112; an image data storage part 114; an uneven concentration correction parameter storage part 116; a defective nozzle data storage part 118; an allowable value range storage part 120; a medium transportation control part 122; an image reading control part 124; a print control part 126; a head driver 128, and the like.

The system controller 110 serves as a control part for controlling the ink jet recording apparatus 1, and includes a Central Processing Unit (CPU), a Random Access Memory (RAM), a Read Only Memory (ROM), and the like. The system controller 110 functions as the control part of the ink jet recording apparatus 1 by allowing the CPU to execute a predetermined control program.

In addition, as described later, the system controller 110 performs the following: creation processing of an uneven concentration correction parameter; detection processing of a non-ejecting nozzle; detection processing of a deflected ejection amount of a nozzle; detection processing of a deflected ejection nozzle; determination processing of an allowable value range of a deflected ejection amount; and the like, by executing the predetermined program.

The program to be executed by the CPU is stored in the ROM.

The image data input part 112 obtains image data (image data expressed by RGB form, and the like, for example) of an image drawn on the medium M. The image data input part 112 includes a communication interface and communicates with an external apparatus connected thereto through the communication interface under control of the system controller 110 to obtain image data of an image drawn on the medium M from the external apparatus.

The image data storage part 114 stores the image data obtained from the image data input part 112. The image data storage part 114 is composed of a semiconductor memory, for example, and reading and writing of data are controlled by the system controller 110.

The uneven concentration correction parameter storage part 116 stores an uneven concentration correction parameter that is necessary at the time of uneven concentration correction. The uneven concentration correction parameter storage part 116 is composed of a nonvolatile semiconductor memory, for example, and reading and writing of data are controlled by the system controller 110.

The defective nozzle data storage part 118 stores defective nozzle data (data showing a position of a nozzle N not allowed to eject ink as a defective nozzle) that is necessary at the time of non-ejection correction. The defective nozzle data storage part 118 is composed of a nonvolatile semiconductor memory, for example, and reading and writing of data are controlled by the system controller 110.

The allowable value range storage part 120 stores information on an allowable value range of a deflected ejection amount, which is necessary at the time of detecting a deflected ejection nozzle. The allowable value range storage part 120 is composed of a nonvolatile semiconductor memory, for example, and reading and writing of data are controlled by the system controller 110.

The medium transportation control part 122 controls the medium feeding part 10 in response to a command from the system controller 110 to control feeding of the medium M.

The image reading control part 124 controls the image reading part 30 in response to a command from the system controller 110 to control reading and writing of an image.

The print control part 126 applies various signal processing to image data to create dot arrangement data under control of the system controller 110 as well as creates a driving signal for driving an actuator corresponding to each of the nozzles N of the ink jet head 22 on the basis of the created dot arrangement data and supplies the created driving signal to a head driver 128. The print control part 126 includes: a concentration data creation part 126A; a correction part 126B; a dot arrangement data creation part 126C; and a driving signal creation part 126D.

The concentration data creation part 126A applies concentration conversion processing to image data to create initial concentration data of each ink color.

The correction part 126B includes a non-ejection correction part 126B1 and an uneven concentration correction part 126B2, and applies non-ejection correction and uneven concentration correction to the concentration data created by the concentration data creation part 126A.

The non-ejection correction part 126B1 applies the non-ejection correction to the concentration data by using the information on a non-ejecting nozzle stored in the defective nozzle data storage part 118.

The uneven concentration correction part 126B2 applies the uneven concentration correction to the concentration data by using the uneven concentration correction parameter stored in the uneven concentration correction parameter storage part 116.

The dot arrangement data creation part 126C applies halftoning processing to the concentration data after correction created by the correction part 126B to create dot arrangement data.

The driving signal creation part 126D creates a driving signal for driving an actuator corresponding to each of the nozzles N of the ink jet head 22 on the basis of the dot arrangement data created by the dot arrangement data creation part 126C.

The head driver 128 serves as a driving circuit for driving the ink jet head 22 provided in the drawing part 20, and drives the ink jet head 22 on the basis of a driving signal supplied from the print control part 126.

(Processing Flow From Input of Image Data to Drawing of Image on Medium M)

A processing flow from input of image data to drawing of an image on the medium M will be outlined below.

Image data of an image drawn on the medium M is inputted into the ink jet recording apparatus 1 through the image data input part 112. The inputted image data is temporarily stored in the image data storage part 114 to be transmitted to the print control part 126.

The image data transmitted to the print control part 126 is first supplied to the concentration data creation part 126A. The concentration data creation part 126A then applies concentration conversion processing to the image data to create concentration data for each ink color.

The created concentration data is supplied to the correction part 126B. The correction part 126B applies non-ejection correction and uneven concentration correction to the concentration data.

The non-ejection correction is then performed by the non-ejection correction part 126B1, which applies the non-ejection correction to the concentration data by using information on a defective nozzle stored in the defective nozzle data storage part 118.

In addition, the uneven concentration correction is performed by the uneven concentration correction part 126B2, which applies the uneven concentration correction to the concentration data by using an uneven concentration correction parameter stored in the uneven concentration correction parameter storage part 116.

The concentration data to which the non-ejection correction and the uneven concentration correction are applied is supplied to the dot arrangement data creation part 126C. The dot arrangement data creation part 126C applies half-toning processing to the concentration data to create dot arrangement data.

The created dot arrangement data is supplied to the driving signal creation part 126D so that the driving signal creation part 126D creates a driving signal for driving an actuator corresponding to each of the nozzles N of the ink jet head 22 on the basis of the dot arrangement data.

The created driving signal is supplied to the head driver 128, which drives the ink jet head 22 on the basis of the driving signal supplied from the print control part 126. Accordingly, ink droplets are ejected from each of the nozzles N of the ink jet head 22 to draw an image on the medium M.

As above, the ink jet recording apparatus 1 of the present embodiment performs the non-ejection correction and the uneven concentration correction at the time of drawing an image to draw the image on the medium M.

Creation of Uneven Concentration Correction Parameter

As described above, the ink jet recording apparatus 1 of the present embodiment performs the uneven concentration correction at the time of drawing an image.

The uneven concentration correction is performed by using an uneven concentration correction parameter, which is created on the basis of a drawing result of a test chart for uneven concentration correction, the test chart being drawn on the medium M.

The uneven concentration correction parameter is created according to the following procedure under control of the system controller 110.

First, the system controller 110 allows the drawing part 20 to draw an image of the test chart for uneven concentration correction.

Then, the system controller 110 allows the image reading part 30 to read the image of the test chart drawn on the medium M.

Next, the system controller 110 obtains image data of the test chart for uneven concentration correction, the image data being read by the image reading part 30.

The obtained image data is then analyzed by using a predetermined analysis program so that an uneven concentration correction parameter necessary for the uneven concentration correction is created, that is, the system controller 110 functions as an uneven concentration correction parameter creation part by executing the predetermined analysis program to create an uneven concentration correction parameter necessary for the uneven concentration correction from the image data of the test chart for uneven concentration correction.

Information on the created uneven concentration correction parameter is stored in the uneven concentration correction parameter storage part 116.

Image data of the test chart for uneven concentration correction to be drawn on the medium M is stored in a ROM in advance. The system controller 110 supplies the image data of the test chart for uneven concentration correction stored in the ROM to the print control part 126 to allow the drawing part 20 to draw an image of the test chart for uneven concentration correction.

Creation of Defective Nozzle Data

As described above, the ink jet recording apparatus 1 of the present embodiment performs the non-ejection correction at the time of drawing an image. The non-ejection correction is performed by using defective nozzle data.

The defective nozzle data serves as data of a position of a nozzle N, which is not allowed to eject ink as a defective nozzle. The defective nozzle includes a nozzle (non-ejecting nozzle) which has fallen into a non-ejecting state due to clogging or failure, and a nozzle (deflected ejection nozzle) in which there is not the non-ejecting state, but deflected ejection occurs by exceeding an allowable value range.

The system controller 110 obtains information on a non-ejecting nozzle and a deflected ejection nozzle to not allow a corresponding nozzle to eject ink, that is, it is determined that an actuator corresponding to the nozzle is not driven. Data of a position of the nozzle not allowed to eject ink is then created as defective nozzle data.

Detection of a defective nozzle is regularly performed to update the defective nozzle data for each detection.

The system controller 110 stores the created defective nozzle data in the defective nozzle data storage part 118.

Detection of Non-Ejecting Nozzle

The detection of a non-ejecting nozzle is performed on the basis of a drawing result of a test chart for non-ejecting nozzle detection drawn on the medium M.

Detection of a non-ejecting nozzle is performed according to the following procedure under control of the system controller 110.

First, the system controller 110 allows the drawing part 20 to draw an image of a test chart for non-ejecting nozzle detection.

Then, the system controller 110 allows the image reading part 30 to read the image of the test chart drawn on the medium M.

Next, the system controller 110 obtains image data of the test chart for non-ejecting nozzle detection, the image data being read by the image reading part 30.

The obtained image data is then analyzed by using a predetermined analysis program so that a non-ejecting nozzle is detected, that is, the system controller 110 functions as a non-ejecting nozzle detector by executing the predetermined analysis program to detect a non-ejecting nozzle from image data of a test chart for non-ejecting nozzle detection.

The system controller 110 creates (updates) defective nozzle data on the basis of information on the detected non-ejecting nozzle.

Image data of the test chart test chart for non-ejecting nozzle detection is stored in a ROM in advance. The system controller 110 supplies the image data of the test chart for non-ejecting nozzle detection stored in the ROM to the print control part 126 to allow the drawing part 20 to draw an image of the test chart for non-ejecting nozzle detection.

The test chart for non-ejecting nozzle detection and the test chart for uneven concentration correction can also be formed into one test chart. In this case, creation of an uneven concentration correction parameter and detection of a non-ejecting nozzle can be performed by using the one test chart.

Detection of a non-ejecting nozzle is regularly performed, or performed each time when one sheet is printed, for example. In this case, an image of the test chart for non-ejecting nozzle detection is drawn in a margin area on the medium M so that a non-ejecting nozzle is detected by reading the image.

Detection of Deflected Ejection Nozzle

In the detection of a deflected ejection nozzle, a deflected ejection amount of each of nozzles is detected to detect a nozzle with a value exceeding an allowable value range as a deflected ejection nozzle.

Detection of Deflected Ejection Amount

The detection of a deflected ejection amount is performed on the basis of a drawing result of a test chart for deflected ejection amount detection drawn on the medium M.

Detection of a deflected ejection amount is performed according to the following procedure under control of the system controller 110.

First, the system controller 110 allows the drawing part 20 to draw an image of a test chart for deflected ejection amount detection.

Then, the system controller 110 allows the image reading part 30 to read the image of the test chart drawn on the medium M.

Next, the system controller 110 obtains image data of the test chart for deflected ejection amount detection, the image data being read by the image reading part 30.

The obtained image data is then analyzed by using a predetermined analysis program so that a deflected ejection amount of each of nozzles is detected, that is, the system controller 110 functions as a deflected ejection amount detector by executing the predetermined analysis program to detect a deflected ejection amount of each of the nozzles from image data of the test chart for deflected ejection amount detection.

The deflected ejection amount of each of nozzles is detected as an amount of deviation from a correct ejection position. The correct ejection position serves as an ejection position of ink, in which deflected ejection does not occur, and which corresponds to a nozzle position, that is, a distance between a nozzle position and an actual ejection position is detected as the deflected ejection amount. Thus, if ink is ejected at the same position as that of a nozzle, the deflected ejection amount is zero.

After a deflected ejection amount of each of nozzles is detected, the system controller 110 detects a nozzle with a value exceeding an allowable value range of a deflected ejection amount as a deflected ejection nozzle.

Image data of the test chart for deflected ejection amount detection is stored in a ROM in advance. The system controller 110 supplies the image data of the test chart for deflected ejection amount detection stored in the ROM to the print control part 126 to allow the drawing part 20 to draw an image of the test chart for deflected ejection amount detection.

The test chart for deflected ejection amount detection and the test chart for uneven concentration correction can also be formed into one test chart. In this case, creation of an uneven concentration correction parameter and detection of a deflected ejection amount can be performed by using the one test chart.

Likewise, the test chart for non-ejecting nozzle detection and the test chart for deflected ejection amount detection can also be formed into one test chart. In this case, detection of a non-ejecting nozzle and detection of a deflected ejection amount can be performed by using the one test chart.

Detection of a deflected ejection amount is regularly performed, or performed each time when one sheet is printed, for example. In this case, an image of the test chart for deflected ejection amount detection is drawn in a margin area on the medium M so that a deflected ejection amount is detected by reading the image.

Determination of Allowable Value Range

As described above, a nozzle in which a deflected ejection amount exceeds an allowable value range so that the deflected ejection occurs is detected as a deflected ejection nozzle.

An allowable value range of a deflected ejection amount is determined for each of nozzles N as well as is determined with respect to a deflected ejection amount of each of the nozzles N at the time of determining an uneven concentration correction parameter, on the basis of the following reason.

FIGS. 6A to 6D are conceptual diagrams of uneven concentration correction to be performed in a state where deflected ejection occurs.

Figure 6A:
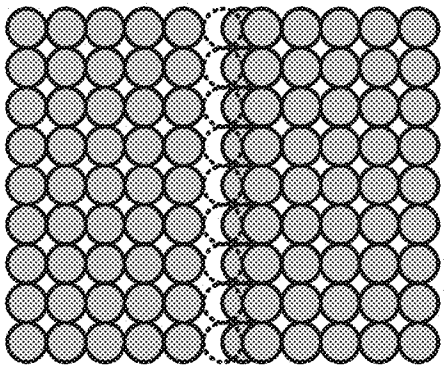
FIGS. 6A to 6D are conceptual diagrams of uneven concentration correction to be performed in a state where deflected ejection occurs.
Figure 6B:
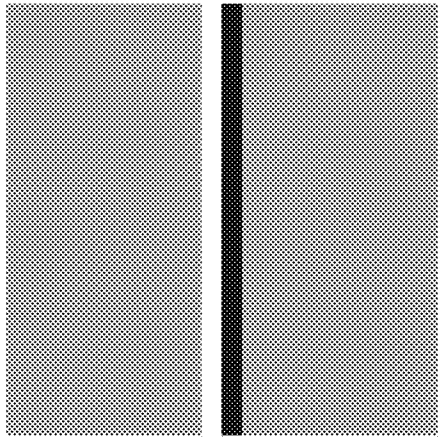
Figure 6C:
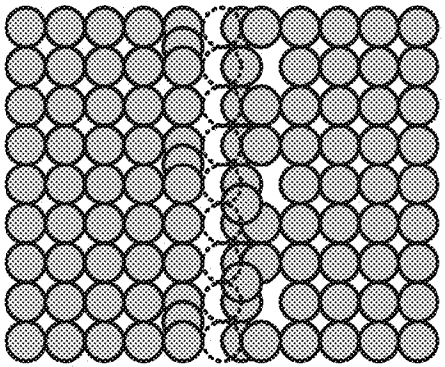
Figure 6D:
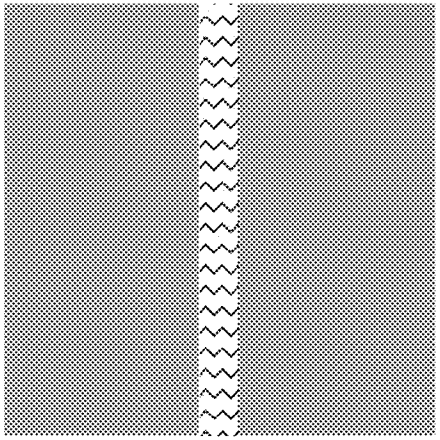

FIGS. 6A to 6D are as follows: FIG. 6A shows schematic dot arrangement when deflected ejection occurs; FIG. 6B shows schematic visual appearance of an output image (image drawn on a medium) when deflected ejection occurs; FIG. 6C shows schematic dot arrangement when uneven concentration correction is performed in a state where the deflected ejection occurs; and FIG. 6D shows schematic visual appearance of an output image when the uneven concentration correction is performed in a state where the deflected ejection occurs.

As shown in FIG. 6D, even if deflected ejection occurs, it is possible to reduce visibility of a streak by performing the uneven concentration correction.

Thus, in a case where the uneven concentration correction is performed, it is thought that an allowable value range of a deflected ejection amount determined with respect to a deflected ejection amount of each of the nozzles when the uneven concentration correction parameter is created can provide a more favorable result than that determined on the basis of a nozzle position.

In the ink jet recording apparatus 1 of the present embodiment, an allowable value range of a deflected ejection amount is determined with respect to a deflected ejection amount of each of the nozzles N at the time of determining an uneven concentration correction parameter.

As described above, an uneven concentration correction parameter is created by drawing a test chart for uneven concentration correction and analyzing an image of the test chart. In addition, a deflected ejection amount of each of nozzles is detected by drawing a test chart for deflected ejection amount detection and analyzing an image of the test chart. Thus, it is possible to obtain a deflected ejection amount of each of the nozzles when the uneven concentration correction parameter is created by simultaneously drawing the test chart for deflected ejection amount detection at the time of drawing the test chart for uneven concentration correction.

As above, a deflected ejection amount of each of the nozzles N at the time of determining an uneven concentration correction parameter is detected by simultaneously drawing a test chart for deflected ejection amount detection at the time of drawing a test chart for uneven concentration correction. The system controller 110 determines an allowable value range of a deflected ejection amount of each of the nozzles N on the basis of the detected deflected ejection amount of each of the nozzles N at the time of determining an uneven concentration correction parameter.

In the ink jet recording apparatus 1 of the present embodiment, a range of values higher and lower by a predetermined value than a deflected ejection amount at the time of determining an uneven concentration correction parameter is determined as an allowable value range, that is, an allowable value range is determined at a range of [P−α] to [P+α] ([P−α] serves as a lower limit value (Min), and [P+α] serves as an upper limit value (Max)), where a deflected ejection amount at the time of determining an uneven concentration correction parameter (reference deflected ejection amount) is indicated as P, and each of value ranges higher and lower than P is indicated as α.

Figure 7:
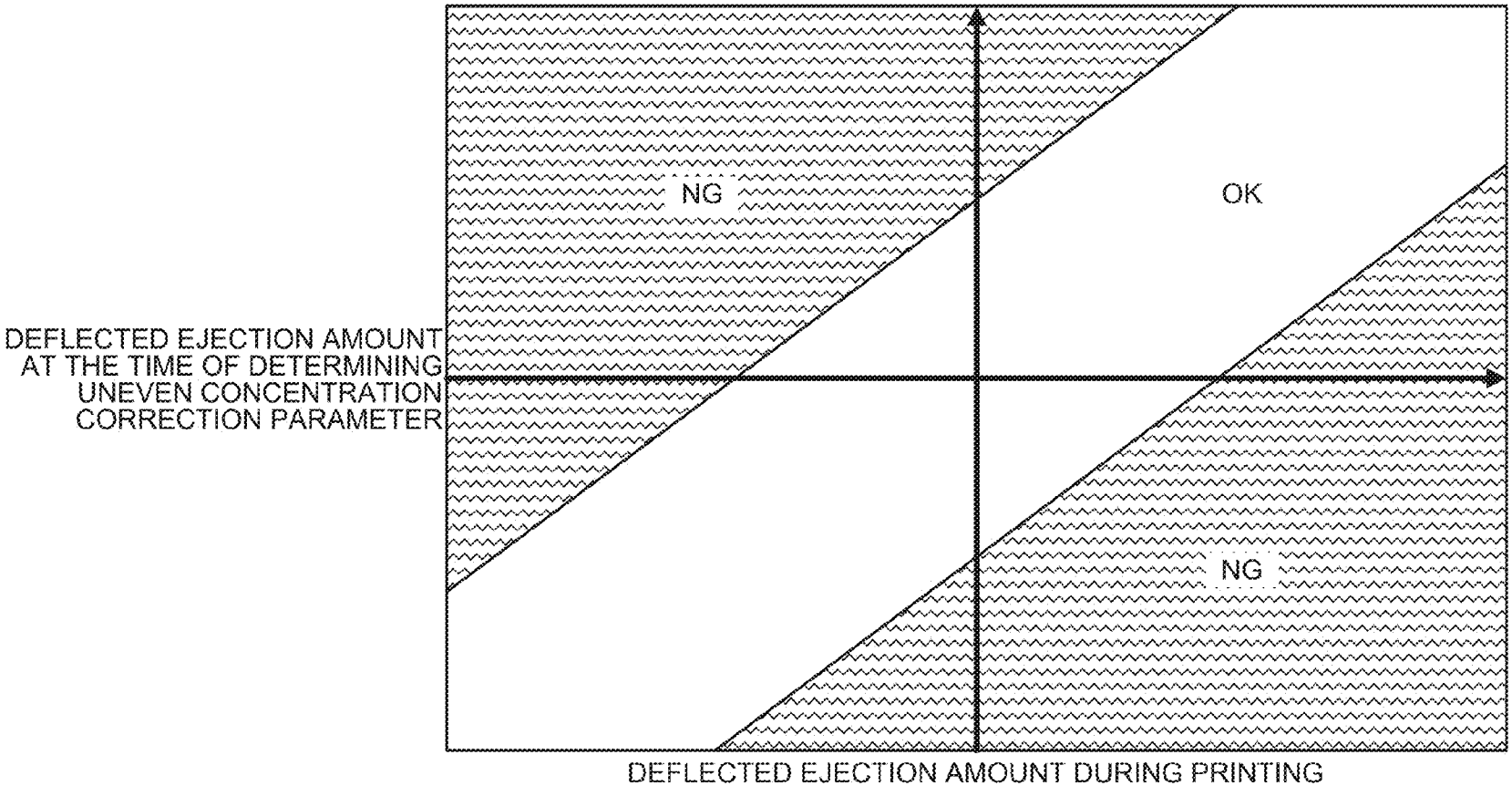
FIG. 7 is a graph showing a relationship between a deflected ejection amount at the time of determining an uneven concentration correction parameter and a deflected ejection amount during normal printing.

FIG. 7 is a graph showing a relationship between a deflected ejection amount at the time of determining an uneven concentration correction parameter and a deflected ejection amount during normal printing. In FIG. 7, a region (white region) indicated as "OK" serves as a range in which a nozzle is determined to be normal, and a region (region with wave lines) indicated as "NG" serves as a range in which it is determined that a nozzle causes deflected ejection.

As shown in FIG. 7, in a case where a range of values higher and lower by a predetermined value than a deflected ejection amount at the time of determining an uneven concentration correction parameter is determined as an allowable value range, even if a nozzle with a large amount of deflected ejection is detected, the nozzle is determined to be normal as far as the amount is within an allowable value range determined for the nozzle, that is, determining an allowable value range as determined in the ink jet recording apparatus 1 of the present embodiment allows a range in which a nozzle is determined to be normal to expand.

Information on a value range α determined as an allowable value range, the value range α serving as each of value ranges higher and lower than a deflected ejection amount P at the time of determining an uneven concentration correction parameter, is stored in a ROM in advance.

The system controller 110 performs determination processing of an allowable value range by executing a predetermined program, that is, the system controller 110 functions as an allowable value range determination part by executing the predetermined program to perform determination processing of an allowable value range by performing detection processing of a deflected ejection amount at the time of determining an uneven concentration correction parameter.

Figure 8:
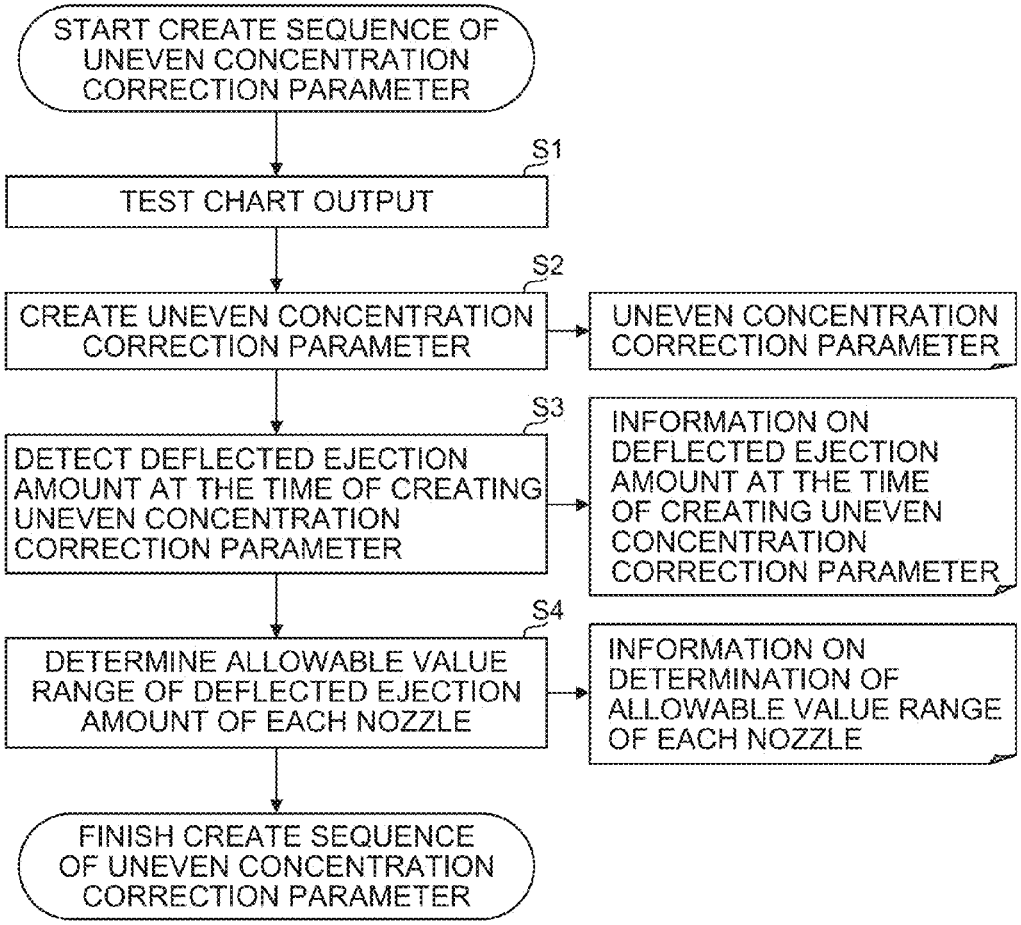
FIG. 8 is a flow chart showing procedure of processing of creating an uneven concentration correction parameter, including processing of determining an allowable value range.

FIG. 8 is a flow chart showing procedure of processing of creating an uneven concentration correction parameter, including processing of determining an allowable value range.

First, output processing of a test chart is performed at step S1, that is, processing of allowing the drawing part 20 to draw a predetermined test chart is performed.

A test chart including an image of a test chart for uneven concentration correction and an image of a test chart for deflected ejection amount detection is then used for a test chart to be drawn by the drawing part 20. Accordingly, it is possible to perform creation of an uneven concentration correction parameter as well as simultaneously perform detection of a deflected ejection amount.

The image reading part 30 reads the drawn image of the test chart to output the image to the system controller 110.

Next, creation processing of an uneven concentration correction parameter is performed at step S2 on the basis of the obtained image data of the test chart, that is, the obtained image data of the test chart is analyzed to perform processing of creating an uneven concentration correction parameter necessary for correction of uneven concentration.

Information on the created uneven concentration correction parameter is stored in the uneven concentration correction parameter storage part 116.

Then, detection processing of a deflected ejection amount of each of nozzles at the time of creating the uneven concentration correction parameter (at the time of drawing the test chart) is performed at step S3 on the basis of the obtained image data of the test chart, that is, the obtained image data of the test chart is analyzed to perform processing of detecting a deflected ejection amount of each of nozzles.

Next, determination processing of an allowable value range is performed at step S4 on the basis of information on the obtained deflected ejection amount of each of nozzles at the time of creating the uneven concentration correction parameter, that is, a range (±α) of values higher and lower by a predetermined value than a deflected ejection amount at the time of creating an uneven concentration correction parameter (P) is determined as the allowable value range to determine an allowable value range (P±α) of a deflected ejection amount for each of the nozzles.

Information on the determined allowable value range of a deflected ejection amount of each of the nozzles is stored in the allowable value range storage part 120.

As above, the creation processing of an uneven concentration correction parameter, including the determination processing of an allowable value range, is finished in a series of the steps.

At the time of drawing (printing) image data inputted from the image data input part 112, uneven concentration correction is performed by using the uneven concentration correction parameter created by the procedure above. In addition, detection of a deflected ejection nozzle is performed on the basis of the information on the allowable value range of a deflected ejection amount of each of nozzles, determined by the procedure above, to perform non-ejection correction.

Processing at Time of Printing

At the time of printing, detection processing of a defective nozzle is performed each time when an image is printed on one sheet so that a detection result of the detection processing is fed back to perform the non-ejection correction.

Hereinafter, procedure (ink jet recording method) for the processing at the time of printing will be described.

Figure 9:
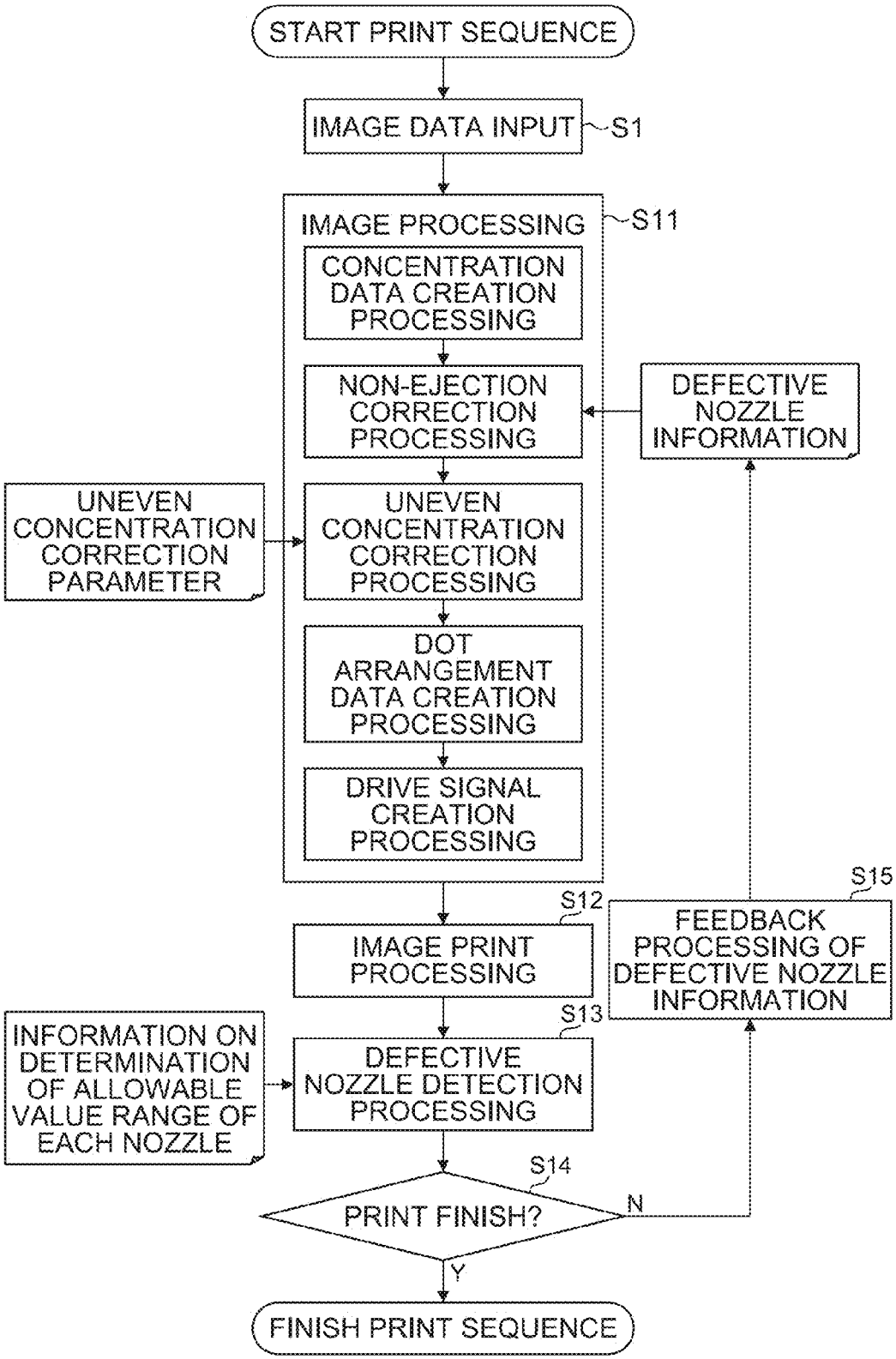
FIG. 9 is a flow chart showing procedure of processing at the time of printing.

FIG. 9 is a flow chart showing procedure of processing at the time of printing.

First, input processing of image data is performed at step S10, that is, image data of an image to be drawn on the medium M is inputted from the image data input part 112.

Next, image processing of the inputted image data is performed at step S11, that is, processing of converting an image shown by the inputted image data into a data form by which the drawing part 20 can draw the image is performed by the print control part 126.

The inputted image data is first supplied to the concentration data creation part 126A. The concentration data creation part 126A applies concentration conversion processing to the image data to create initial concentration data of each ink color.

The concentration data created by the concentration data creation part 126A is supplied to the correction part 126B to perform non-ejection correction processing and uneven concentration correction processing.

Then, the non-ejection correction is performed by the non-ejection correction part 126B1, and the uneven concentration correction is performed by the uneven concentration correction part 126B2. The non-ejection correction part 126B1 applies non-ejection correction to the concentration data by using the information on a defective nozzle stored in the defective nozzle data storage part 118. In addition, the uneven concentration correction part 126B2 applies the uneven concentration correction to the concentration data by using the uneven concentration correction parameter stored in the uneven concentration correction parameter storage part 116.

The concentration data to which the non-ejection correction and the uneven concentration correction are applied by the correction part 126B is then supplied to the dot arrangement data creation part 126C. The dot arrangement data creation part 126C applies half-toning processing to the concentration data to create dot arrangement data.

The dot arrangement data created by the dot arrangement data creation part 126C is supplied to the driving signal creation part 126D so that the driving signal creation part 126D creates a driving signal for driving an actuator corresponding to each of the nozzles N of the ink jet head 22 on the basis of the dot arrangement data.

As above, a driving signal for driving each ink jet head 22 of the drawing part 20 is created.

Next, the ink jet head 22 is driven in accordance with the created driving signal to perform printing processing of the inputted image data at step S12.

An image to be drawn on the medium M includes an image of a test chart for deflected ejection amount detection and a test chart for non-ejecting nozzle detection. The image of the test chart for deflected ejection amount detection and the image of the test chart for non-ejecting nozzle detection are drawn in a margin area on the medium M.

The image reading part 30 reads the image of the test chart for deflected ejection amount detection and the image of the test chart for non-ejecting nozzle detection, drawn on the medium M, to perform defective nozzle detection processing on the basis of image data of the read test chart for deflected ejection amount detection and image data of the read test chart for non-ejecting nozzle detection at step S13, that is, a non-ejecting nozzle and a deflected ejection nozzle are detected as defective nozzles.

A nozzle in which a deflected ejection amount exceeds an allowable value range so that the deflected ejection occurs is detected as a deflected ejection nozzle. The allowable value range is determined for each of nozzles and stored in the allowable value range storage part 120.

The system controller 110 detects a nozzle in which a deflected ejection amount exceeds an allowable value range so that the deflected ejection occurs as a deflected ejection nozzle by referring to information on the allowable value range of a deflected ejection amount of each of nozzles, stored in the allowable value range storage part 120.

After detection processing for a defective nozzle, determination processing of determining whether every scheduled printing is finished is performed at step S14. If the every printing is finished, printing processing is finished.

On the other hand, if the every printing is not finished, feedback processing of defective nozzle information is performed at step S15 on the basis of information on the detected defective nozzle, that is, processing of not allowing a newly detected defective nozzle to eject ink as well as updating the defective nozzle data stored in the defective nozzle data storage part 118 is performed.

Thus, non-ejection correction is applied to a medium to be printed next on the basis of the updated defective nozzle data.

As above, at the time of printing, printing processing is performed while defective nozzle data is sequentially updated. Accordingly, it is possible to maintain always stable image quality.

In addition, since a deflected ejection nozzle is detected as a defective nozzle with respect to a deflected ejection amount of each of nozzles when an uneven concentration correction parameter is created, it is possible to properly detect a deflected ejection nozzle to properly perform the non-ejection correction. Accordingly, it is possible to consistently draw a high quality image.

Variation

Variation of Determination of Allowable Value Range

As described above, the present invention is configured to determine an allowable value range of a deflected ejection amount with respect to a deflected ejection amount at the time of determining an uneven concentration correction parameter, and detect a nozzle in which a deflected ejection amount exceeds the determined allowable value range so that the deflected ejection occurs as a deflected ejection nozzle.

In addition, the embodiment above is configured to determine a range of values higher and lower by a predetermined value than a deflected ejection amount of each of nozzles at the time of determining an uneven concentration correction parameter, as the allowable value range, however, a determination method of the allowable value range is not limited to the method described above. Another aspect of a determination method of the allowable value range will be described below.

Aspect of Determining Allowable Value Range Depending on Deflected Ejection Amount at Time of Creating Uneven Concentration Correction Parameter It is thought that an allowable value range of a deflected ejection amount to be determined for each of the nozzles differs depending on a deflected ejection amount at the time of creating an uneven concentration correction parameter, that is, it is thought that as a deflected ejection amount at the time of creating an uneven concentration correction parameter increases, a value range settable to the allowable value range becomes narrow. In addition, it is thought that a value range settable to upper and lower sides (amplitude upper and lower sides) also differs depending on a deflected ejection amount at the time of creating an uneven concentration correction parameter.

Thus, the allowable value range is determined corresponding to a deflected ejection amount at the time of creating an uneven concentration correction parameter. Accordingly, it is thought that it is possible to more properly determine an allowable value range of a deflected ejection amount to more properly detect a deflected ejection nozzle.

In a case of the present aspect, an allowable value range to be determined corresponding to a deflected ejection amount at the time of creating an uneven concentration correction parameter is predetermined.

It is possible to determine the relationship between a deflected ejection amount at the time of creating an uneven concentration correction parameter and an allowable value range to be determined by desk study such as theory and simulation, study by experiment, and the like.

Figure 10:
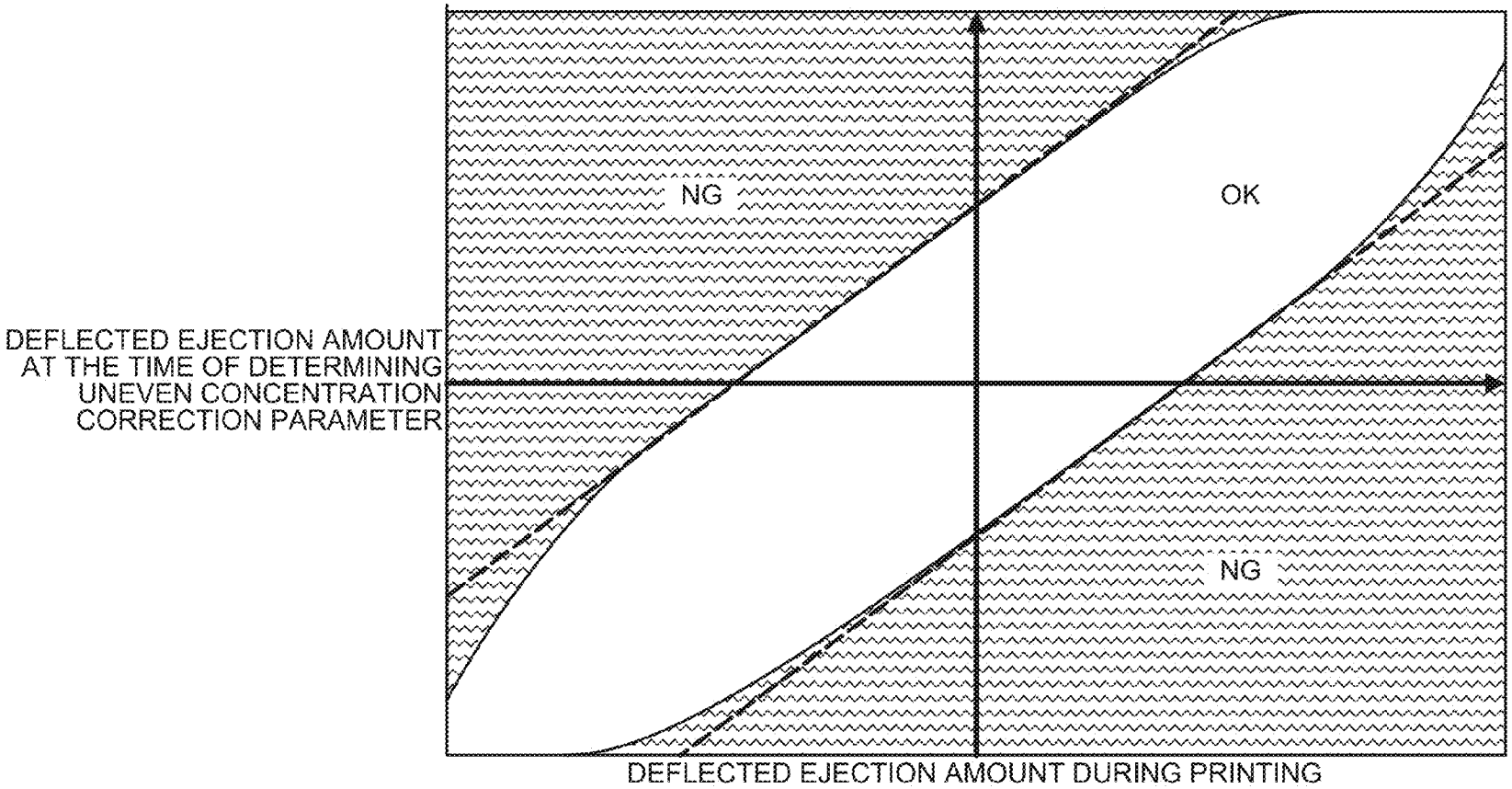
FIG. 10 is a graph showing a relationship between a deflected ejection amount at the time of determining an uneven concentration correction parameter when an allowable value range is determined corresponding to a deflected ejection amount at the time of creating an uneven concentration correction parameter, and a deflected ejection amount during normal printing.

FIG. 10 is an example of a graph showing a relationship between a deflected ejection amount at the time of determining an uneven concentration correction parameter when an allowable value range is determined corresponding to a deflected ejection amount at the time of creating an uneven concentration correction parameter, and a deflected ejection amount during normal printing. In FIG. 10, a region (white region) indicated as "OK" serves as a range in which a nozzle is determined to be normal, and a region (region with wave lines) indicated as "NG" serves as a range in which it is determined that a nozzle causes deflected ejection.

In the example shown in FIG. 10, as a deflected ejection amount at the time of creating an uneven concentration correction parameter increases, an allowable value range is determined so as to be narrower.

In addition, in the example shown in FIG. 10, a different value range is applied to an upper side (the right side area of "OK" range; the range between the solid line and the dash line) and a lower side (the left side area of "OK" range; the range between the solid line and the dash line) of an allowable value range (a range indicated by "OK") of a deflected ejection amount at the time of determining an uneven concentration correction parameter, that is, a value range of an upper limit (Max) side and a value range of a lower limit (Min) side, of an allowable value range determined by allowing a deflected ejection amount at the time of determining an uneven concentration correction parameter to be a central value, are determined so as to be different (the upper limit side and the lower limit side are determined so as to be asymmetric).

As above, it is possible to more properly determine an allowable value range of a deflected ejection amount by determining the allowable value range corresponding to a deflected ejection amount at the time of creating an uneven concentration correction parameter to more properly detect a deflected ejection nozzle.

Information showing a relationship between a deflected ejection amount at the time of creating an uneven concentration correction parameter and an allowable value range to be determined is prepared as a table, for example, so as to be stored in a ROM serving as a storage part.

When determining a deflected ejection amount of each of nozzles, the system controller 110 determines an allowable value range of a deflected ejection amount of each of nozzles by referring to the table stored in the ROM (table in which a relationship between a deflected ejection amount at the time of creating an uneven concentration correction parameter and an allowable value range to be determined is defined).

Aspect of Preparing Table for Each Nozzle

It is thought that an allowable value range settable to each of the nozzles differs for each of the nozzles, that is, it is thought that influence of deflected ejection on image quality differs depending on a position of a nozzle, and the like.

Thus, it is possible to more properly determine the allowable value range by predetermining a relationship between a deflected ejection amount at the time of creating an uneven concentration correction parameter and an allowable value range to be determined, for each of the nozzles. Accordingly, it is possible to more properly detect a deflected ejection nozzle.

In this case, a table, in which a relationship between a deflected ejection amount at the time of creating an uneven concentration correction parameter and an allowable value range to be determined is defined, is prepared for each of the nozzles so as to be stored in a ROM serving as a storage part.

When determining a deflected ejection amount of each of nozzles, the system controller 110 determines an allowable value range of a deflected ejection amount of each of nozzles by referring to the table stored in the ROM.

Aspect of Preparing Table for Each Group of Nozzles

As described above, it is thought that influence of deflected ejection on image quality differs depending on a position of a nozzle, and the like.

However, if the table for determining an allowable value range is prepared for each of nozzles, the number of the tables becomes enormous.

Thus, the nozzles are divided into groups to prepare a table for determining an allowable value range in units of the group.

Accordingly, it is possible to properly determine the allowable value range while reducing the number of pieces of information to be managed.

In a case where the ink jet head 22 is composed of a plurality of modules like the ink jet recording apparatus 1 of the embodiment described above, for example, it is thought to adopt a method of grouping nozzles in units of the module as the grouping. In addition, it is possible to adopt a method of dividing nozzle surfaces along array directions of nozzles into a plurality of blocks so that the nozzles are grouped in units of the block.

Aspect of Determining Allowable Value Range of Deflected Ejection Amount for Each Nozzle As described above, it is preferable to determine an allowable value range of a deflected ejection amount for each of nozzles.

In the example described above, an allowable value range of a deflected ejection amount of each of nozzles is determined with respect to a deflected ejection amount of each of nozzles when an uneven concentration correction parameter is created, however, it is also possible to determine an allowable value range of each of nozzles by desk study such as theory and simulation, study by experiment, and the like.

For example, determining a deflected ejection amount to be reference (a reference deflected ejection amount) for each of nozzles enables a range of values higher and lower by a predetermined value than the reference deflected ejection amount to be determined as an allowable value range. In this case, it is possible to determine an optimum value as the reference deflected ejection amount by desk study such as theory and simulation, study by experiment, and the like.

Variation of Image Processing

The embodiment described above is configured to allow the correction part 126B of the print control part 126 to perform uneven concentration correction and non-ejection correction, that is, uneven concentration correction and non-ejection correction are performed by applying predetermined signal processing to concentration data. Various methods are known for uneven concentration correction and non-ejection correction. Thus, a method for uneven concentration correction and non-ejection correction is not limited to the method of the embodiment described above, so that it is possible to adopt methods of a variety of forms.

Creation Timing of Uneven Concentration Correction Parameter

Although the creation timing of an uneven concentration correction parameter is not particularly limited, it is possible to maintain a favorable image by regularly performing the creation.

Detection Timing of Defective Nozzle

Although the embodiment described above is configured to perform detection processing of a defective nozzle every time when one sheet is printed, the detection timing of a defective nozzle is not particularly limited. It is possible to apply a configuration in which the detection processing is performed every time when a predetermined number of sheets are printed. In addition, it is possible to obtain a higher quality image by reducing a detection interval.

Variation of Configuration of Ink Jet Recording Apparatus

Although the embodiment described above is configured to feed the medium M by using belt conveyance in the medium feeding part 10, a configuration of the medium feeding part 10 is not limited to the configuration above. In addition, it is possible to adopt a method of feeding a medium by allowing the medium to adhere to a peripheral surface of a drum (drum feeding), a method of feeding a medium by pinching the medium from the front and back thereof with rollers and rotating the rollers (roller feeding), and the like.

Further, it is also possible to adopt not only a piezoelectric method but also a thermal method as a drive method of the ink jet head 22.

The embodiment described above is composed of one long ink jet head formed by joining a plurality of head modules, however, it is possible to form the ink jet head with a single unit.

In addition, in the embodiment described above, although nozzles are arranged in a matrix in a nozzle surface, it is also possible to arrange the nozzles along a longitudinal direction in a line.

EXAMPLE

Image quality is compared in the following: a case where non-ejection correction is performed by determining an allowable value range of a deflected ejection amount on the basis of a nozzle position to detect a deflected ejection nozzle (a conventional method); and a case where non-ejection correction is performed by determining an allowable value range with respect to a deflected ejection amount at the time of creating an uneven concentration correction parameter to detect a deflected ejection nozzle (a method of the present invention).

Figure 11:
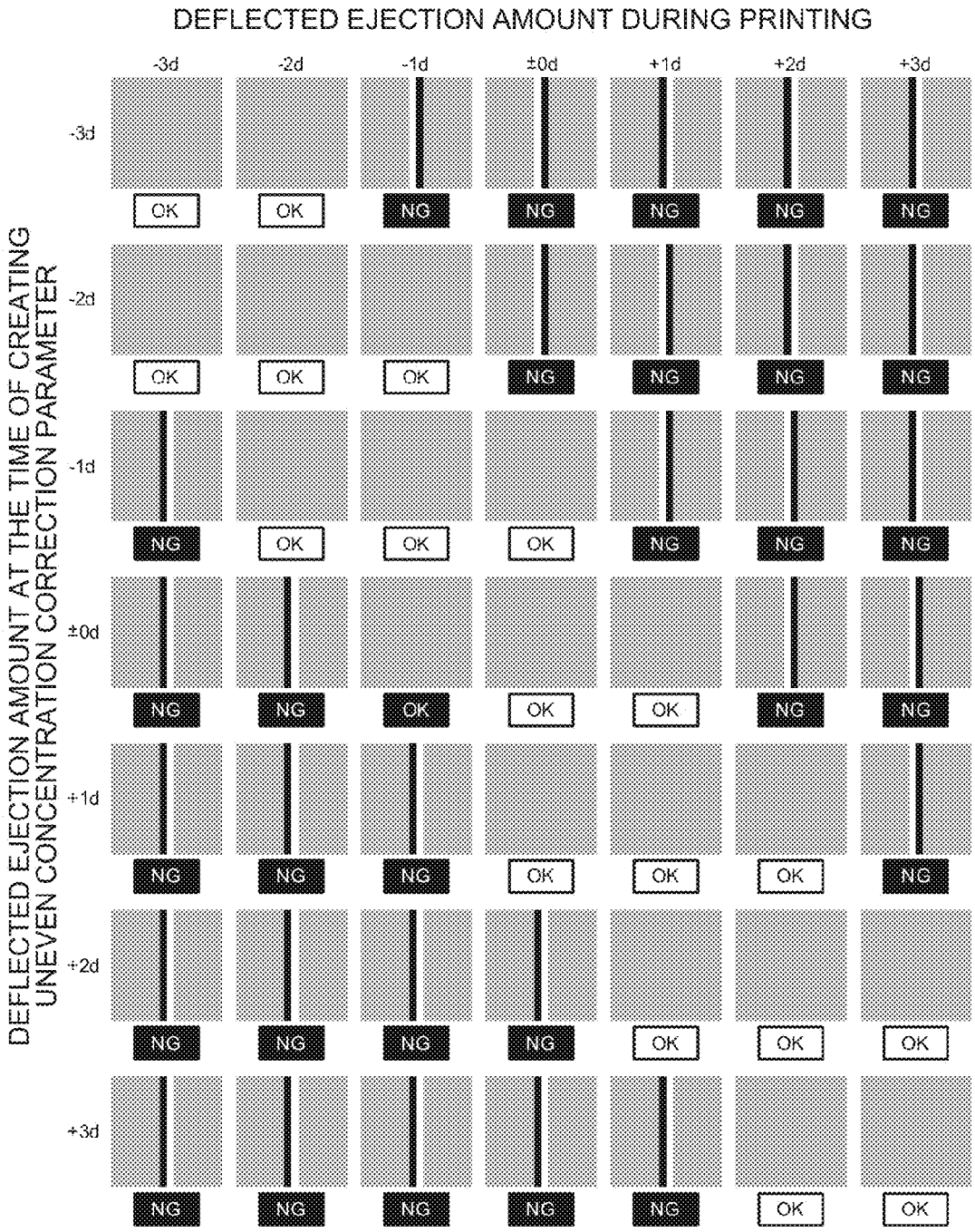
FIG. 11 schematically shows a correspondence relationship between a deflected ejection amount at the time of performing only uneven concentration correction without performing non-ejection correction, and appearance of a streak of an output image.

FIG. 11 schematically shows a correspondence relationship between a deflected ejection amount at the time of performing only uneven concentration correction without performing non-ejection correction, and appearance of a streak of an output image.

Figure 12:
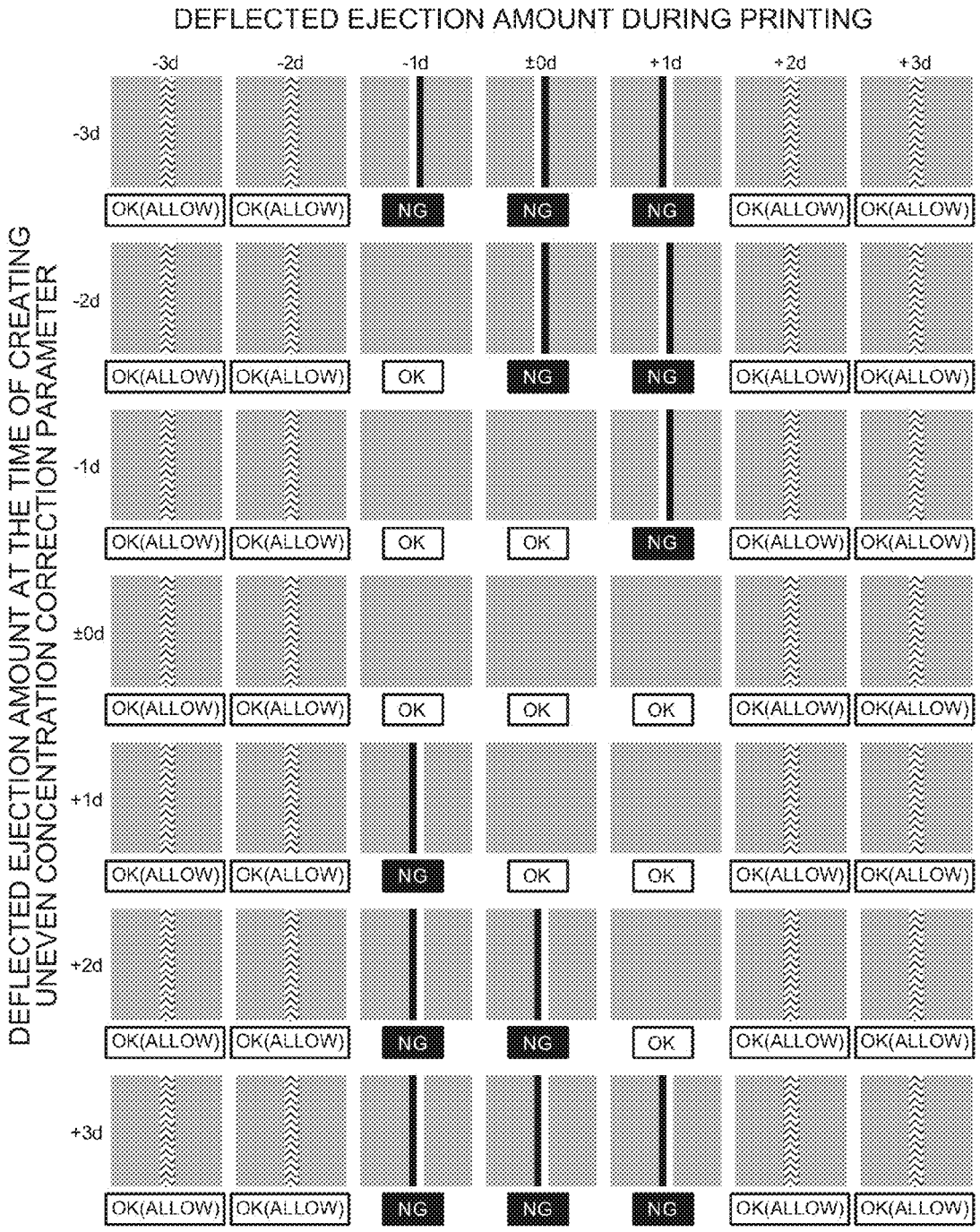
FIG. 12 schematically shows a correspondence relationship between a deflected ejection amount in a case where a deflected ejection nozzle is detected by using a conventional method to perform non-ejection correction as well as uneven concentration correction is performed, and appearance of a streak of an output image.

FIG. 12 schematically shows a correspondence relationship between a deflected ejection amount in a case where a deflected ejection nozzle is detected by using a conventional method to perform non-ejection correction as well as uneven concentration correction is performed, and appearance of a streak of an output image, that is, FIG. 12 schematically shows a correspondence relationship between a deflected ejection amount in a case where an allowable value range is determined on the basis of a nozzle position when a deflected ejection nozzle is detected, and appearance of a streak.

In FIGS. 11 and 12, a deflected ejection amount at the time of creating an uneven concentration correction parameter is shown in a vertical direction (a column direction), and a deflected ejection amount during printing is shown in a horizontal direction (a row direction).

In addition, "d" in FIGS. 11 and 12 indicates a unit of a deflected ejection amount. In FIGS. 11 and 12, an overlapping amount of dots adjacent to each other is indicated as 1d. Nozzles are usually arranged so that ink droplets ejected from nozzles adjacent to each other overlap with each other, and therefore, an amount to be overlapped is indicated as a unit of a deflected ejection amount. Thus, there is no overlap in a range within ±1d.

As shown in FIG. 11, in a case where uneven concentration correction is performed, even if deflected ejection occurs during printing, it is possible to maintain favorable image quality if the deflected ejection amount corresponds with a deflected ejection amount at the time of creating an uneven concentration correction parameter, or is in a region close to the deflected ejection amount at the time of creating an uneven concentration correction parameter.

In even a case where a deflected ejection of −3d occurs during printing, for example, if a deflected ejection amount at the time of creating an uneven concentration correction parameter is also −3d, as a result, favorable image quality is maintained.

On the other hand, in even a case where no deflected ejection occurs during printing (in a case where a deflected ejection amount is ±0d), if a deflected ejection amount at the time of creating an uneven concentration correction parameter is −3d, as a result, a streak occurs.

Further, in a case where uneven concentration correction and non-ejection correction are performed as shown in FIG. 12, if an allowable value range of a deflected ejection amount is determined on the basis of a nozzle position to detect a deflected ejection nozzle, unnecessary non-ejection correction is performed to conversely lower image quality.

In the example shown in FIG. 12, an allowable value range of a deflected ejection amount is determined within a range of ±1d on the basis of a nozzle position. In this case, if a deflected ejection occurs by exceeding the range of ±1d, a corresponding nozzle is forced to not eject ink to perform non-ejection correction.

In a case where a deflected ejection of −3d occurs during printing, for example, a corresponding nozzle is not allowed to eject ink to perform non-ejection correction. However, in a case where uneven concentration correction is performed, if a deflected ejection amount at the time of creating an uneven concentration correction parameter of the corresponding nozzle is −3d, as a result, favorable image quality is maintained. Thus, in this case, performing non-ejection correction results in conversely lowering image quality.

Accordingly, in a case where uneven concentration correction is performed, it is perceived that detecting a deflected ejection nozzle on the basis of a deflected ejection amount of each of nozzles at the time of creating an uneven concentration correction parameter to perform non-ejection correction can maintain more favorable image quality than detecting a deflected ejection nozzle on the basis of a nozzle position to perform non-ejection correction.

Figure 13:
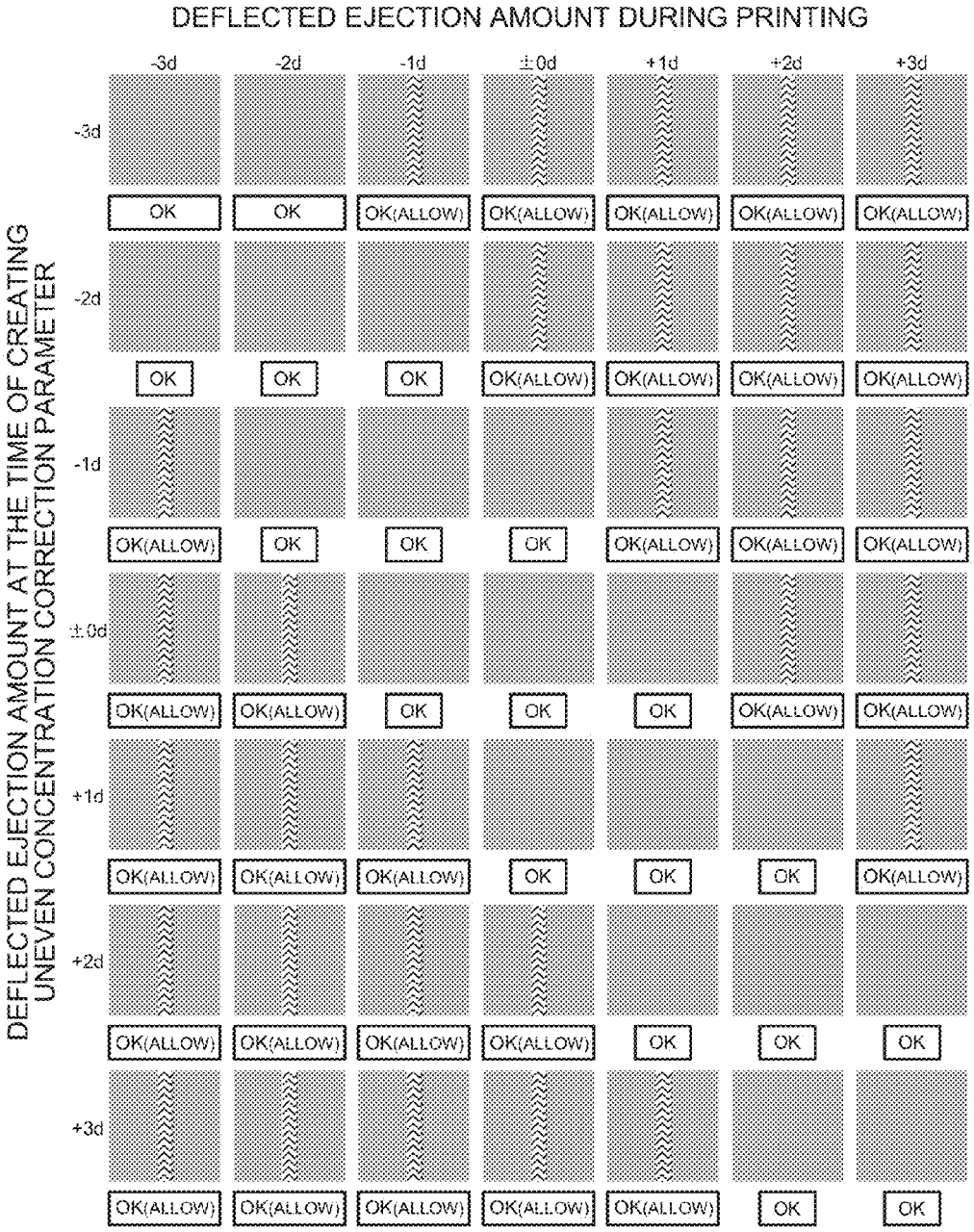
FIG. 13 schematically shows a correspondence relationship between a deflected ejection amount in a case where a deflected ejection nozzle is detected by using a method of the present invention to perform non-ejection correction as well as uneven concentration correction is performed, and appearance of a streak of an output image.
Figure 14A:
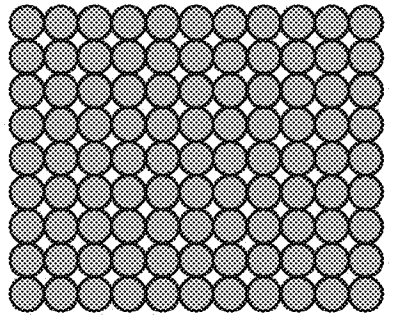
RELATED ART FIG.14A
FIGS. 14A to 14F are conceptual diagrams showing a basic idea of non-ejection correction.
Figure 14B:
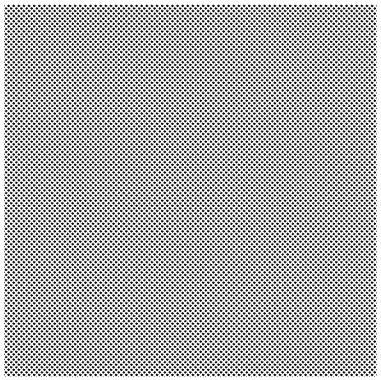
Figure 14C:
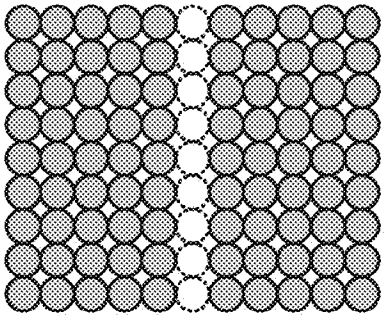
Figure 14D:
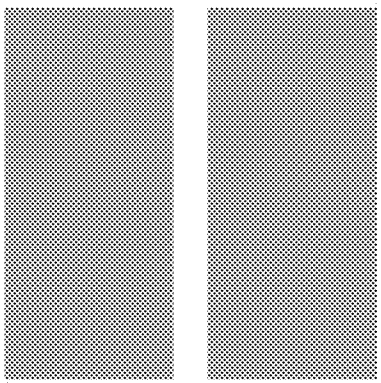
Figure 14E:
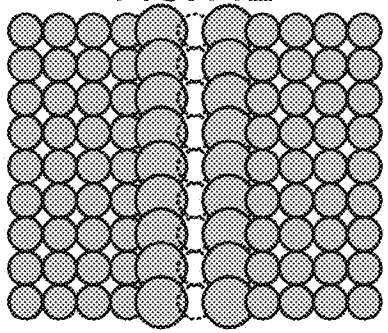
Figure 14F:
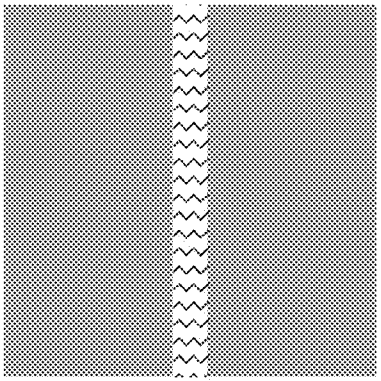
Figure 15A:
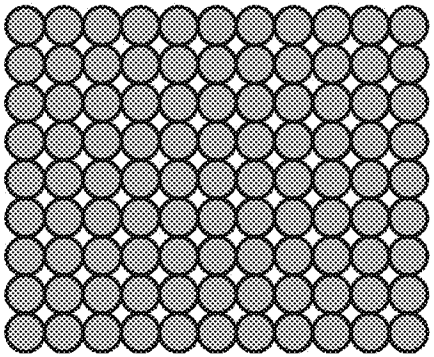
RELATED ART FIG.15A
FIGS. 15A to 15D are conceptual diagrams showing an occurrence mechanism of a streak caused by deflected ejection.
Figure 15B:
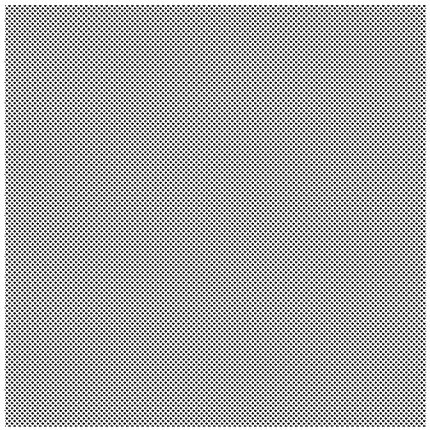
Figure 15C:
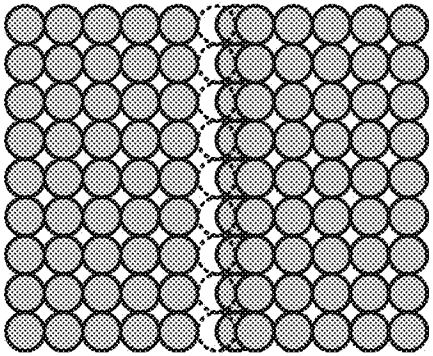
Figure 15D:
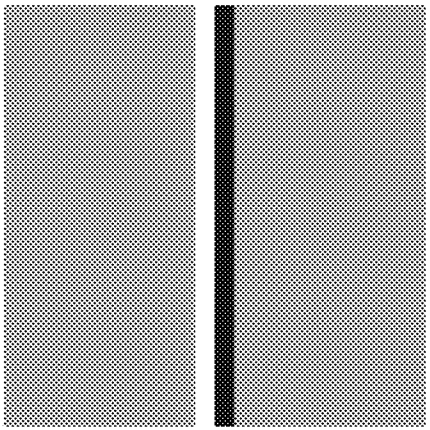

FIG. 13 schematically shows a correspondence relationship between a deflected ejection amount in a case where a deflected ejection nozzle is detected by using a method of the present invention to perform non-ejection correction as well as uneven concentration correction is performed, and appearance of a streak of an output image, that is, FIG. 13 schematically shows a correspondence relationship between a deflected ejection amount in a case where an allowable value range is determined with respect to a deflected ejection amount at the time of creating an uneven concentration correction parameter when a deflected ejection nozzle is detected, and appearance of a streak.

In the example shown in FIG. 13, an allowable value range is determined as a range within ±1d with respect to a deflected ejection amount at the time of creating an uneven concentration correction parameter.

In this case, even if a large amount of deflected ejection occurs during printing, non-ejection correction is not performed as far as the deflected ejection amount is within the allowable value range.

In a case where a deflected ejection of −3d occurs in a nozzle during printing, for example, it is unconditionally determined that the nozzle is a deflected ejection nozzle by using a conventional method, so that non-ejection correction is performed.

In the present invention, however, in even a case where a deflected ejection of −3d occurs in a nozzle during printing, if a deflected ejection amount of the nozzle at the time of creating an uneven concentration correction parameter is −3d, it is not determined that the nozzle is a deflected ejection nozzle, so that non-ejection correction is not performed. Accordingly, it is possible to prevent excessive non-ejection correction, and as a result, a high quality image can be obtained.

As above, it is possible to properly detect a deflected ejection nozzle by determining an allowable value range of a deflected ejection amount with respect to a deflected ejection amount at the time of creating an uneven concentration correction parameter. Accordingly, it is possible to properly perform non-ejection correction to maintain high image quality.

What is claimed is:

1. An ink jet recording apparatus comprising:

an ink jet head for ejecting ink droplets from a plurality of nozzles to draw an image on a medium;

a deflected ejection amount detector for detecting a deflected ejection amount of each of the nozzles;

an uneven concentration correction parameter creation part for creating an uneven concentration correction parameter required for uneven concentration correction by analyzing an image of a test chart drawn on the medium by the ink jet head;

an uneven concentration correction part for performing uneven concentration correction on the basis of the uneven concentration correction parameter created by the uneven concentration correction parameter creation part;

an allowable value range determination part for determining an allowable value range of a deflected ejection amount for each of the nozzles with respect to a deflected ejection amount of each of the nozzles when the test chart is drawn;

a deflected ejection nozzle detector for detecting a nozzle in which a deflected ejection amount exceeds the allowable value range so that a deflected ejection occurs, as a deflected ejection nozzle; and a non-ejection correction part for performing non-ejection correction by not allowing the deflected ejection nozzle to eject ink.

2. The ink jet recording apparatus according to claim 1, wherein the allowable value range determination part determines a range of values higher and lower by a predetermined value than a deflected ejection amount of each of the nozzles when the test chart is drawn as the allowable value range.

3. The ink jet recording apparatus according to claim 1, further comprising a storage part for storing information on the allowable value range to be determined corresponding to a deflected ejection amount when the test chart is drawn, wherein the allowable value range determination part determines the allowable value range by referring to the information stored in the storage part.

4. The ink jet recording apparatus according to claim 3, wherein information on the allowable value range to be determined corresponding to a deflected ejection amount when the test chart is drawn is determined for each of the nozzles, and stored in the storage part.

5. The ink jet recording apparatus according to claim 4, wherein as a deflected ejection amount when the test chart is drawn increases, the allowable value range to be determined is determined so as to be narrower.

6. The ink jet recording apparatus according to claim 3, wherein as a deflected ejection amount when the test chart is drawn increases, the allowable value range to be determined is determined so as to be narrower.

7. The ink jet recording apparatus according to claim 3, wherein the nozzles are divided into a plurality of groups, and information on the allowable value range to be determined is determined corresponding to a deflected ejection amount when the test chart is drawn for each of the groups, and stored in the storage part.

8. The ink jet recording apparatus according to claim 7, wherein as a deflected ejection amount when the test chart is drawn increases, the allowable value range to be determined is determined so as to be narrower.

9. An ink jet recording method of ejecting ink droplets from a plurality of nozzles provided in an ink jet head to draw an image on a medium, the ink jet recording method comprising performing uneven concentration correction and non-ejection correction at the time of drawing an image, the uneven concentration correction including the steps of:

drawing a test chart on the medium with the ink jet head;

analyzing an image of the drawn test chart;

creating an uneven concentration correction parameter required for the uneven concentration correction; and performing the uneven concentration correction on the basis of the created uneven concentration correction parameter, and the non-ejection correction including the steps of:

determining an allowable value range of a deflected ejection amount for each of the nozzles with respect to a deflected ejection amount of each of nozzles when the test chart is drawn;

detecting a nozzle in which a deflected ejection amount exceeds the allowable value range so that the deflected ejection occurs as a deflected ejection nozzle; and not allowing the detected deflected ejection nozzle to eject ink to perform the non-ejection correction.

10. The ink jet recording method according to claim 9, wherein a range of values higher and lower by a predetermined value than a deflected ejection amount of each of the nozzles when the test chart is drawn is determined as the allowable value range.

11. The ink jet recording method according to claim 9, wherein the allowable value range to be determined is predetermined corresponding to a deflected ejection amount when the test chart is drawn.

12. The ink jet recording method according to claim 11, wherein the allowable value range to be determined corresponding to a deflected ejection amount when the test chart is drawn is predetermined for each of the nozzles.

13. The ink jet recording method according to claim 12, wherein as a deflected ejection amount when the test chart is drawn increases, the allowable value range to be determined is determined so as to be narrower.

14. The ink jet recording method according to claim 11, wherein as a deflected ejection amount when the test chart is drawn increases, the allowable value range to be determined is determined so as to be narrower.

15. The ink jet recording method according to claim 11, wherein the nozzles are divided into a plurality of groups, and the allowable value range to be determined is predetermined corresponding to a deflected ejection amount when the test chart is drawn for each of the groups.

16. The ink jet recording method according to claim 15, wherein as a deflected ejection amount when the test chart is drawn increases, the allowable value range to be determined is determined so as to be narrower.

* * * * *